US011664601B2

(12) United States Patent
Irci et al.

(10) Patent No.: US 11,664,601 B2
(45) Date of Patent: May 30, 2023

(54) ELECTRONIC DEVICES WITH COEXISTING ANTENNAS

(71) Applicant: Apple Inc., Cupertino, CA (US)

(72) Inventors: Erdinc Irci, Sunnyvale, CA (US); Bilgehan Avser, San Bruno, CA (US); Han Wang, Campbell, CA (US); Harish Rajagopalan, San Jose, CA (US); Hongfei Hu, Cupertino, CA (US); Jingni Zhong, Santa Clara, CA (US); Ming Chen, Cupertino, CA (US); Nanbo Jin, San Jose, CA (US); Yijun Zhou, Mountain View, CA (US)

(73) Assignee: Apple Inc., Cupertino, CA (US)

( * ) Notice: Subject to any disclaimer, the term of this patent is extended or adjusted under 35 U.S.C. 154(b) by 195 days.

(21) Appl. No.: 17/032,843

(22) Filed: Sep. 25, 2020

(65) Prior Publication Data

US 2022/0102867 A1 Mar. 31, 2022

(51) Int. Cl.

| | |
|---|---|
| ***H01Q 1/24*** | (2006.01) |
| ***H01Q 13/10*** | (2006.01) |
| ***H01Q 1/52*** | (2006.01) |
| ***H01Q 3/30*** | (2006.01) |
| ***H01Q 1/48*** | (2006.01) |

(52) U.S. Cl.

CPC ..... *H01Q 13/10* (2013.01); *H01Q 1/48* (2013.01); *H01Q 1/526* (2013.01); *H01Q 3/30* (2013.01)

(58) Field of Classification Search

CPC ..... H01Q 1/241–243; H01Q 1/52; H01Q 1/48–50; H01Q 3/26–30; H01Q 13/10; H01Q 5/30–50; H01Q 5/378–385

See application file for complete search history.

(56) References Cited

U.S. PATENT DOCUMENTS

| | | | | |
|---|---|---|---|---|
| 8,179,322 | B2 | 5/2012 | Nissinen | |
| 9,577,331 | B2 * | 2/2017 | Tseng | H01Q 21/28 |
| 9,768,507 | B2 | 9/2017 | Rajgopal et al. | |
| 10,530,042 | B2 * | 1/2020 | Avser | H01Q 5/50 |
| 2010/0073241 | A1 | 3/2010 | Ayala Vazquez et al. | |
| 2013/0293424 | A1 | 11/2013 | Zhu et al. | |
| 2020/0153082 | A1 | 5/2020 | Mangrum | |
| 2020/0266539 | A1 | 8/2020 | Cooper et al. | |

* cited by examiner

*Primary Examiner* — Hasan Islam

(74) *Attorney, Agent, or Firm* — Treyz Law Group, P.C.; Tianyi He

(57) ABSTRACT

An electronic device may be provided with an antenna module. A phased antenna array of dielectric resonator antennas may be disposed within the antenna module. The dielectric resonator antennas may include dielectric columns excited by feed probes. A flexible printed circuit may include transmission lines coupled to the feed probes. The flexible printed circuit may have a first end coupled to the antenna module and extending towards peripheral conductive housing structures forming an additional antenna and a second end coupled to transceiver circuitry. Ground traces on the flexible printed circuit may be shorted to ground structures at the first and second ends to improve the antenna efficiency of the additional antenna. The flexible printed circuit may include an elongated slot with overlapping conductive structures and laterally surrounded by a fence of conductive vias to improve the flexibility of the flexible printed circuit while providing satisfactory antenna performance.

20 Claims, 11 Drawing Sheets

ELECTRONIC DEVICES WITH COEXISTING ANTENNAS

BACKGROUND

This relates generally to electronic devices and, more particularly, to electronic devices with wireless circuitry.

Electronic devices often include wireless circuitry. For example, cellular telephones, computers, and other devices often contain antennas and wireless transceivers for supporting wireless communications.

It may be desirable to support wireless communications in millimeter wave and centimeter wave communications bands. Millimeter wave communications, which are sometimes referred to as extremely high frequency (EHF) communications, and centimeter wave communications involve communications at frequencies of about 10-300 GHz. Operation at these frequencies may support high bandwidths but may raise significant challenges. For example, the presence of conductive electronic device components and other antenna elements can also make it difficult to incorporate circuitry for handling millimeter and centimeter wave communications into the electronic device, especially in compact devices having limited interior space. In addition, if care is not taken, manufacturing variations can undesirably impact the mechanical reliability of the antennas in the electronic device, and different antennas may undesirably impact each other.

It would therefore be desirable to be able to provide electronic devices with improved components for supporting millimeter and centimeter wave communications and wireless communications in general.

SUMMARY

An electronic device may be provided with a housing, a display, and wireless circuitry. The housing may include peripheral conductive housing structures that run around a periphery of the device. The display may include a display cover layer mounted to the peripheral conductive housing structures. An antenna ground (e.g., ground structures) may be separated from the peripheral conductive housing structures by a slot. The wireless circuitry may include a phased antenna array that conveys radio-frequency signals in one or more frequency bands between 10 GHz and 300 GHz. The phased antenna array may convey the radio-frequency signals through the display cover layer or other dielectric cover layers in the device.

A phased antenna array may be formed from dielectric resonator antennas disposed within the antenna module. The dielectric resonator antennas may include dielectric columns excited by feed probes. The antenna module may be mounted in the slot between the peripheral conductive housing structures and the antenna ground by an attachment structure (e.g., by a screw in the attachment structure). The peripheral conductive housing structures and the antenna ground may form an additional antenna. A tunable element for the additional antenna may be coupled across the slot. The screw may form a conductive path from the peripheral conductive housing structures to the tunable element.

A flexible printed circuit may include transmission lines coupled to the feed probes to feed the dielectric resonator antennas. The transmission lines may be separated from each other using corresponding fences of conductive vias in the flexible printed circuit. The flexible printed circuit may have a first end coupled to the antenna module and extending towards peripheral conductive housing structures forming the additional antenna and a second end coupled to transceiver circuitry. Ground traces on the flexible printed circuit may be shorted to ground structures at the first and second ends to improve the antenna efficiency of the additional antenna. The flexible printed circuit may include an elongated slot with overlapping conductive structures and laterally surrounded by a fence of conductive vias to improve the flexibility of the flexible printed circuit while providing satisfactory antenna performance.

DETAILED DESCRIPTION

Figure 1:
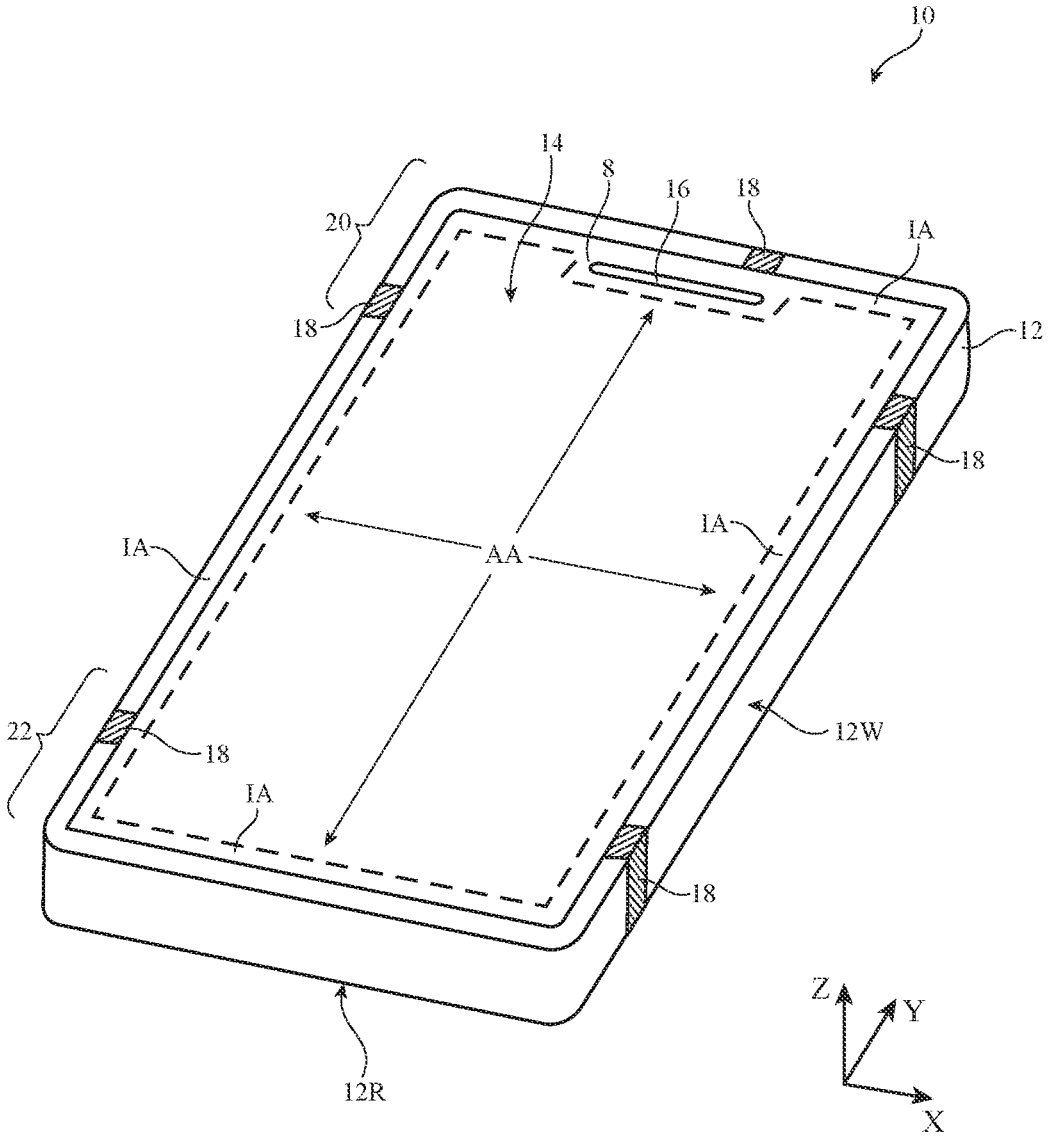
FIG. 1 is a perspective view of an illustrative electronic device in accordance with some embodiments.

An electronic device such as electronic device 10 of FIG. 1 may contain wireless circuitry. The wireless circuitry may include one or more antennas. The antennas may include phased antenna arrays that are used for performing wireless communications using millimeter and centimeter wave signals. Millimeter wave signals, which are sometimes referred to as extremely high frequency (EHF) signals, propagate at frequencies above about 30 GHz (e.g., at 60 GHz or other frequencies between about 30 GHz and 300 GHz). Centimeter wave signals propagate at frequencies between about 10 GHz and 30 GHz. If desired, device 10 may also contain antennas for handling satellite navigation system signals, cellular telephone signals, local wireless area network signals, near-field communications, light-based wireless communications, or other wireless communications.

Electronic device 10 may be a portable electronic device or other suitable electronic device. For example, electronic device 10 may be a laptop computer, a tablet computer, a somewhat smaller device such as a wrist-watch device, pendant device, headphone device, earpiece device, or other wearable or miniature device, a handheld device such as a cellular telephone, a media player, or other small portable device. Device 10 may also be a set-top box, a desktop computer, a display into which a computer or other processing circuitry has been integrated, a display without an integrated computer, a wireless access point, a wireless base station, an electronic device incorporated into a kiosk, building, or vehicle, or other suitable electronic equipment.

Device 10 may include a housing such as housing 12. Housing 12, which may sometimes be referred to as a case, may be formed of plastic, glass, ceramics, fiber composites, metal (e.g., stainless steel, aluminum, etc.), other suitable materials, or a combination of these materials. In some situations, parts of housing 12 may be formed from dielectric or other low-conductivity material (e.g., glass, ceramic, plastic, sapphire, etc.). In other situations, housing 12 or at least some of the structures that make up housing 12 may be formed from metal elements.

Device 10 may, if desired, have a display such as display 14. Display 14 may be mounted on the front face of device 10 (e.g., display 14 may form some or all of the front face of the device). Display 14 may be a touch screen that incorporates capacitive touch electrodes or may be insensitive to touch. The rear face of housing 12 (i.e., the face of device 10 opposing the front face of device 10) may have a substantially planar housing wall such as rear housing wall 12R (e.g., a planar housing wall). Rear housing wall 12R may have slots that pass entirely through the rear housing wall and that therefore separate portions of housing 12 from each other. Rear housing wall 12R may include conductive portions and/or dielectric portions. If desired, rear housing wall 12R may include a planar metal layer covered by a thin layer or coating of dielectric such as glass, plastic, sapphire, or ceramic. Housing 12 may also have shallow grooves that do not pass entirely through housing 12. The slots and grooves may be filled with plastic or other dielectrics. If desired, portions of housing 12 that have been separated from each other (e.g., by a through slot) may be joined by internal conductive structures (e.g., sheet metal or other metal members that bridge the slot).

Housing 12 may include peripheral housing structures such as peripheral structures 12W. Conductive portions of peripheral structures 12W and conductive portions of rear housing wall 12R may sometimes be referred to herein collectively as conductive structures of housing 12. Peripheral structures 12W may run around the periphery of device 10 and display 14. In configurations in which device 10 and display 14 have a rectangular shape with four edges, peripheral structures 12W may be implemented using peripheral housing structures that have a rectangular ring shape with four corresponding edges and that extend from rear housing wall 12R to the front face of device 10 (as an example). Peripheral structures 12W or part of peripheral structures 12W may serve as a bezel for display 14 (e.g., a cosmetic trim that surrounds all four sides of display 14 and/or that helps hold display 14 to device 10) if desired. Peripheral structures 12W may, if desired, form sidewall structures for device 10 (e.g., by forming a metal band with vertical sidewalls, curved sidewalls, etc.).

Peripheral structures 12W may be formed of a conductive material such as metal and may therefore sometimes be referred to as peripheral conductive housing structures, conductive housing structures, peripheral metal structures, peripheral conductive sidewalls, peripheral conductive sidewall structures, conductive housing sidewalls, peripheral conductive housing sidewalls, sidewalls, sidewall structures, or a peripheral conductive housing member (as examples). Peripheral conductive housing structures 12W may be formed from a metal such as stainless steel, aluminum, or other suitable materials. One, two, or more than two separate structures may be used in forming peripheral conductive housing structures 12W.

It is not necessary for peripheral conductive housing structures 12W to have a uniform cross-section. For example, the top portion of peripheral conductive housing structures 12W may, if desired, have an inwardly protruding ledge that helps hold display 14 in place. The bottom portion of peripheral conductive housing structures 12W may also have an enlarged lip (e.g., in the plane of the rear surface of device 10). Peripheral conductive housing structures 12W may have substantially straight vertical sidewalls, may have sidewalls that are curved, or may have other suitable shapes. In some configurations (e.g., when peripheral conductive housing structures 12W serve as a bezel for display 14), peripheral conductive housing structures 12W may run around the lip of housing 12 (i.e., peripheral conductive housing structures 12W may cover only the edge of housing 12 that surrounds display 14 and not the rest of the sidewalls of housing 12).

Rear housing wall 12R may lie in a plane that is parallel to display 14. In configurations for device 10 in which some or all of rear housing wall 12R is formed from metal, it may be desirable to form parts of peripheral conductive housing structures 12W as integral portions of the housing structures forming rear housing wall 12R. For example, rear housing wall 12R of device 10 may include a planar metal structure and portions of peripheral conductive housing structures 12W on the sides of housing 12 may be formed as flat or curved vertically extending integral metal portions of the planar metal structure (e.g., housing structures 12R and 12W may be formed from a continuous piece of metal in a unibody configuration). Housing structures such as these may, if desired, be machined from a block of metal and/or may include multiple metal pieces that are assembled together to form housing 12. Rear housing wall 12R may have one or more, two or more, or three or more portions. Peripheral conductive housing structures 12W and/or conductive portions of rear housing wall 12R may form one or more exterior surfaces of device 10 (e.g., surfaces that are visible to a user of device 10) and/or may be implemented using internal structures that do not form exterior surfaces of device 10 (e.g., conductive housing structures that are not visible to a user of device 10 such as conductive structures that are covered with layers such as thin cosmetic layers, protective coatings, and/or other coating layers that may include dielectric materials such as glass, ceramic, plastic, or other structures that form the exterior surfaces of device 10 and/or serve to hide peripheral conductive housing structures 12W and/or conductive portions of rear housing wall 12R from view of the user).

Display 14 may have an array of pixels that form an active area AA that displays images for a user of device 10. For example, active area AA may include an array of display pixels. The array of pixels may be formed from liquid crystal display (LCD) components, an array of electrophoretic pixels, an array of plasma display pixels, an array of organic light-emitting diode display pixels or other light-emitting diode pixels, an array of electrowetting display pixels, or display pixels based on other display technologies. If desired, active area AA may include touch sensors such as touch sensor capacitive electrodes, force sensors, or other sensors for gathering a user input.

Display 14 may have an inactive border region that runs along one or more of the edges of active area AA. Inactive area IA of display 14 may be free of pixels for displaying images and may overlap circuitry and other internal device structures in housing 12. To block these structures from view by a user of device 10, the underside of the display cover layer or other layers in display 14 that overlap inactive area IA may be coated with an opaque masking layer in inactive area IA. The opaque masking layer may have any suitable color. Inactive area IA may include a recessed region such as notch 8 that extends into active area AA. Active area AA may, for example, be defined by the lateral area of a display module for display 14 (e.g., a display module that includes pixel circuitry, touch sensor circuitry, etc.). The display module may have a recess or notch in upper region 20 of device 10 that is free from active display circuitry (i.e., that forms notch 8 of inactive area IA). Notch 8 may be a substantially rectangular region that is surrounded (defined) on three sides by active area AA and on a fourth side by peripheral conductive housing structures 12W.

Display 14 may be protected using a display cover layer such as a layer of transparent glass, clear plastic, transparent ceramic, sapphire, or other transparent crystalline material, or other transparent layer(s). The display cover layer may have a planar shape, a convex curved profile, a shape with planar and curved portions, a layout that includes a planar main area surrounded on one or more edges with a portion that is bent out of the plane of the planar main area, or other suitable shapes. The display cover layer may cover the entire front face of device 10. In another suitable arrangement, the display cover layer may cover substantially all of the front face of device 10 or only a portion of the front face of device 10. Openings may be formed in the display cover layer. For example, an opening may be formed in the display cover layer to accommodate a button. An opening may also be formed in the display cover layer to accommodate ports such as speaker port 16 in notch 8 or a microphone port. Openings may be formed in housing 12 to form communications ports (e.g., an audio jack port, a digital data port, etc.) and/or audio ports for audio components such as a speaker and/or a microphone if desired.

Display 14 may include conductive structures such as an array of capacitive electrodes for a touch sensor, conductive lines for addressing pixels, driver circuits, etc. Housing 12 may include internal conductive structures such as metal frame members and a planar conductive housing member (sometimes referred to as a backplate) that spans the walls of housing 12 (i.e., a substantially rectangular sheet formed from one or more metal parts that is welded or otherwise connected between opposing sides of peripheral conductive housing structures 12W). The backplate may form an exterior rear surface of device 10 or may be covered by layers such as thin cosmetic layers, protective coatings, and/or other coatings that may include dielectric materials such as glass, ceramic, plastic, or other structures that form the exterior surfaces of device 10 and/or serve to hide the backplate from view of the user. Device 10 may also include conductive structures such as printed circuit boards, components mounted on printed circuit boards, and other internal conductive structures. These conductive structures, which may be used in forming a ground plane in device 10, may extend under active area AA of display 14, for example.

In regions 22 and 20, openings may be formed within the conductive structures of device 10 (e.g., between peripheral conductive housing structures 12W and opposing conductive ground structures such as conductive portions of rear housing wall 12R, conductive traces on a printed circuit board, conductive electrical components in display 14, etc.). These openings, which may sometimes be referred to as gaps, may be filled with air, plastic, and/or other dielectrics and may be used in forming slot antenna resonating elements for one or more antennas in device 10, if desired.

Conductive housing structures and other conductive structures in device 10 may serve as a ground plane for the antennas in device 10. The openings in regions 22 and 20 may serve as slots in open or closed slot antennas, may serve as a central dielectric region that is surrounded by a conductive path of materials in a loop antenna, may serve as a space that separates an antenna resonating element such as a strip antenna resonating element or an inverted-F antenna resonating element from the ground plane, may contribute to the performance of a parasitic antenna resonating element, or may otherwise serve as part of antenna structures formed in regions 22 and 20. If desired, the ground plane that is under active area AA of display 14 and/or other metal structures in device 10 may have portions that extend into parts of the ends of device 10 (e.g., the ground may extend towards the dielectric-filled openings in regions 22 and 20), thereby narrowing the slots in regions 22 and 20.

In general, device 10 may include any suitable number of antennas (e.g., one or more, two or more, three or more, four or more, etc.). The antennas in device 10 may be located at opposing first and second ends of an elongated device housing (e.g., ends at regions 22 and 20 of device 10 of FIG. 1), along one or more edges of a device housing, in the center of a device housing, in other suitable locations, or in one or more of these locations. The arrangement of FIG. 1 is merely illustrative.

Portions of peripheral conductive housing structures 12W may be provided with peripheral gap structures. For example, peripheral conductive housing structures 12W may be provided with one or more gaps such as gaps 18, as shown in FIG. 1. The gaps in peripheral conductive housing structures 12W may be filled with dielectric such as polymer, ceramic, glass, air, other dielectric materials, or combinations of these materials. Gaps 18 may divide peripheral conductive housing structures 12W into one or more peripheral conductive segments. The conductive segments that are formed in this way may form parts of antennas in device 10 if desired. Gaps 18 may be omitted if desired. Other dielectric openings may be formed in peripheral conductive housing structures 12W (e.g., dielectric openings other than gaps 18) and may serve as dielectric antenna windows for antennas mounted within the interior of device 10. Antennas within device 10 may be aligned with the dielectric antenna windows for conveying radio-frequency signals through peripheral conductive housing structures 12W. Antennas within device 10 may also be aligned with inactive area IA of display 14 for conveying radio-frequency signals through display 14.

In order to provide an end user of device 10 with as large of a display as possible (e.g., to maximize an area of the device used for displaying media, running applications, etc.), it may be desirable to increase the amount of area at the front face of device 10 that is covered by active area AA of display 14. Increasing the size of active area AA may reduce the size of inactive area IA within device 10. This may reduce the area behind display 14 that is available for antennas within device 10. For example, active area AA of display 14 may include conductive structures that serve to block radio-frequency signals handled by antennas mounted behind active area AA from radiating through the front face of device 10. It would therefore be desirable to be able to provide antennas that occupy a small amount of space within device 10 (e.g., to allow for as large of a display active area AA as possible) while still allowing the antennas to communicate with wireless equipment external to device 10 with satisfactory efficiency bandwidth.

In a typical scenario, device 10 may have one or more upper antennas and one or more lower antennas (as an example). An upper antenna may, for example, be formed at the upper end of device 10 in region 20. A lower antenna may, for example, be formed at the lower end of device 10 in region 22. Additional antennas may be formed along the edges of housing 12 extending between regions 20 and 22 if desired. The antennas may be used separately to cover identical communications bands, overlapping communications bands, or separate communications bands. The antennas may be used to implement an antenna diversity scheme or a multiple-input-multiple-output (MIMO) antenna scheme. Other antennas for covering any other desired frequencies may also be mounted at any desired locations within the interior of device 10. The example of FIG. 1 is merely illustrative. If desired, housing 12 may have other shapes (e.g., a square shape, cylindrical shape, spherical shape, combinations of these and/or different shapes, etc.).

Figure 2:
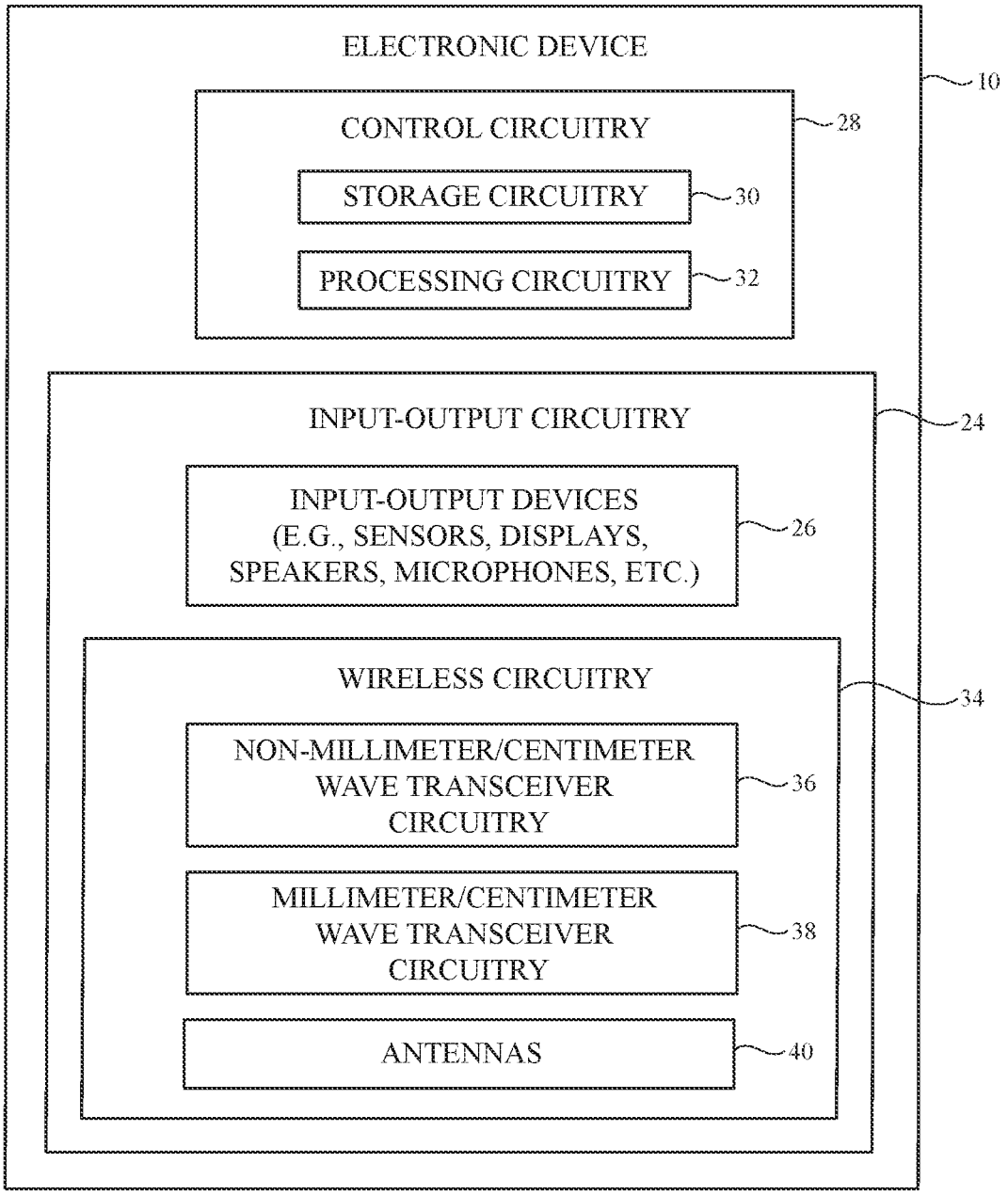
FIG. 2 is a schematic diagram of illustrative circuitry in an electronic device in accordance with some embodiments.

A schematic diagram of illustrative components that may be used in device 10 is shown in FIG. 2. As shown in FIG. 2, device 10 may include control circuitry 28. Control circuitry 28 may include storage such as storage circuitry 30. Storage circuitry 30 may include hard disk drive storage, nonvolatile memory (e.g., flash memory or other electrically-programmable-read-only memory configured to form a solid-state drive), volatile memory (e.g., static or dynamic random-access-memory), etc. Control circuitry 28 may include processing circuitry such as processing circuitry 32. Processing circuitry 32 may be used to control the operation of device 10. Processing circuitry 32 may include on one or more microprocessors, microcontrollers, digital signal processors, host processors, baseband processor integrated circuits, application specific integrated circuits, central processing units (CPUs), etc. Control circuitry 28 may be configured to perform operations in device 10 using hardware (e.g., dedicated hardware or circuitry), firmware, and/or software. Software code for performing operations in device 10 may be stored on storage circuitry 30 (e.g., storage circuitry 30 may include non-transitory (tangible) computer readable storage media that stores the software code). The software code may sometimes be referred to as program instructions, software, data, instructions, or code. Software code stored on storage circuitry 30 may be executed by processing circuitry 32.

Control circuitry 28 may be used to run software on device 10 such as internet browsing applications, voice-over-internet-protocol (VOIP) telephone call applications, email applications, media playback applications, operating system functions, etc. To support interactions with external equipment, control circuitry 28 may be used in implementing communications protocols. Communications protocols that may be implemented using control circuitry 28 include internet protocols, wireless local area network protocols (e.g., IEEE 802.11 protocols—sometimes referred to as WiFi®), protocols for other short-range wireless communications links such as the Bluetooth® protocol or other WPAN protocols, IEEE 802.11ad protocols, cellular telephone protocols, MIMO protocols, antenna diversity protocols, satellite navigation system protocols, antenna-based spatial ranging protocols (e.g., radio detection and ranging (RADAR) protocols or other desired range detection protocols for signals conveyed at millimeter and centimeter wave frequencies), etc. Each communication protocol may be associated with a corresponding radio access technology (RAT) that specifies the physical connection methodology used in implementing the protocol.

Device 10 may include input-output circuitry 24. Input-output circuitry 24 may include input-output devices 26. Input-output devices 26 may be used to allow data to be supplied to device 10 and to allow data to be provided from device 10 to external devices. Input-output devices 26 may include user interface devices, data port devices, sensors, and other input-output components. For example, input-output devices may include touch screens, displays without touch sensor capabilities, buttons, joysticks, scrolling wheels, touch pads, key pads, keyboards, microphones, cameras, speakers, status indicators, light sources, audio jacks and other audio port components, digital data port devices, light sensors, gyroscopes, accelerometers or other components that can detect motion and device orientation relative to the Earth, capacitance sensors, proximity sensors (e.g., a capacitive proximity sensor and/or an infrared proximity sensor), magnetic sensors, and other sensors and input-output components.

Input-output circuitry 24 may include wireless circuitry such as wireless circuitry 34 for wirelessly conveying radio-frequency signals. While control circuitry 28 is shown separately from wireless circuitry 34 in the example of FIG. 2 for the sake of clarity, wireless circuitry 34 may include processing circuitry that forms a part of processing circuitry 32 and/or storage circuitry that forms a part of storage circuitry 30 of control circuitry 28 (e.g., portions of control circuitry 28 may be implemented on wireless circuitry 34). As an example, control circuitry 28 may include baseband processor circuitry or other control components that form a part of wireless circuitry 34.

Wireless circuitry 34 may include millimeter and centimeter wave transceiver circuitry such as millimeter/centimeter wave transceiver circuitry 38. Millimeter/centimeter wave transceiver circuitry 38 may support communications at frequencies between about 10 GHz and 300 GHz. For example, millimeter/centimeter wave transceiver circuitry 38 may support communications in Extremely High Frequency (EHF) or millimeter wave communications bands between about 30 GHz and 300 GHz and/or in centimeter wave communications bands between about 10 GHz and 30 GHz (sometimes referred to as Super High Frequency (SHF) bands). As examples, millimeter/centimeter wave transceiver circuitry 38 may support communications in an IEEE K communications band between about 18 GHz and 27 GHz, a $K_a$ communications band between about 26.5 GHz and 40 GHz, a $K_u$ communications band between about 12 GHz and 18 GHz, a V communications band between about 40 GHz and 75 GHz, a W communications band between about 75 GHz and 110 GHz, or any other desired frequency band between approximately 10 GHz and 300 GHz. If desired, millimeter/centimeter wave transceiver circuitry 38 may support IEEE 802.11ad communications at 60 GHz and/or 5th generation mobile networks or $5^{th}$ generation wireless systems (5G) communications bands between 27 GHz and 90 GHz. Millimeter/centimeter wave transceiver circuitry 38 may be formed from one or more integrated circuits (e.g., multiple integrated circuits mounted on a common printed circuit in a system-in-package device, one or more integrated circuits mounted on different substrates, etc.).

If desired, millimeter/centimeter wave transceiver circuitry 38 (sometimes referred to herein simply as transceiver circuitry 38 or millimeter/centimeter wave circuitry 38) may perform spatial ranging operations using radio-frequency signals at millimeter and/or centimeter wave signals that are transmitted and received by millimeter/centimeter wave transceiver circuitry 38. The received signals may be a version of the transmitted signals that have been reflected off of external objects and back towards device 10. Control circuitry 28 may process the transmitted and received signals to detect or estimate a range between device 10 and one or more external objects in the surroundings of device 10 (e.g., objects external to device 10 such as the body of a user or other persons, other devices, animals, furniture, walls, or other objects or obstacles in the vicinity of device 10). If desired, control circuitry 28 may also process the transmitted and received signals to identify a two or three-dimensional spatial location of the external objects relative to device 10.

Spatial ranging operations performed by millimeter/centimeter wave transceiver circuitry 38 are unidirectional. Millimeter/centimeter wave transceiver circuitry 38 may additionally or alternatively perform bidirectional communications with external wireless equipment. Bidirectional communications involve both the transmission of wireless data by millimeter/centimeter wave transceiver circuitry 38 and the reception of wireless data that has been transmitted by external wireless equipment. The wireless data may, for example, include data that has been encoded into corresponding data packets such as wireless data associated with a telephone call, streaming media content, internet browsing, wireless data associated with software applications running on device 10, email messages, etc.

If desired, wireless circuitry 34 may include transceiver circuitry for handling communications at frequencies below 10 GHz such as non-millimeter/centimeter wave transceiver circuitry 36. Non-millimeter/centimeter wave transceiver circuitry 36 may include wireless local area network (WLAN) transceiver circuitry that handles 2.4 GHz and 5 GHz bands for Wi-Fi® (IEEE 802.11) communications, wireless personal area network (WPAN) transceiver circuitry that handles the 2.4 GHz Bluetooth® communications band, cellular telephone transceiver circuitry that handles cellular telephone communications bands from 700 to 960 MHz, 1710 to 2170 MHz, 2300 to 2700 MHz, and/or or any other desired cellular telephone communications bands between 600 MHz and 4000 MHz, GPS receiver circuitry that receives GPS signals at 1575 MHz or signals for handling other satellite positioning data (e.g., GLONASS signals at 1609 MHz), television receiver circuitry, AM/FM radio receiver circuitry, paging system transceiver circuitry, ultra-wideband (UWB) transceiver circuitry, near field communications (NFC) circuitry, etc. Non-millimeter/centimeter wave transceiver circuitry 36 and millimeter/centimeter wave transceiver circuitry 38 may each include one or more integrated circuits, power amplifier circuitry, low-noise input amplifiers, passive radio-frequency components, switching circuitry, transmission line structures, and other circuitry for handling radio-frequency signals. Non-millimeter/centimeter wave transceiver circuitry 36 may be omitted if desired.

Wireless circuitry 34 may include antennas 40. Non-millimeter/centimeter wave transceiver circuitry 36 may convey radio-frequency signals below 10 GHz using one or more antennas 40. Millimeter/centimeter wave transceiver circuitry 38 may convey radio-frequency signals above 10 GHz (e.g., at millimeter wave and/or centimeter wave frequencies) using antennas 40. In general, transceiver circuitry 36 and 38 may be configured to cover (handle) any suitable communications (frequency) bands of interest. The transceiver circuitry may convey radio-frequency signals using antennas 40 (e.g., antennas 40 may convey the radio-frequency signals for the transceiver circuitry). The term "convey radio-frequency signals" as used herein means the transmission and/or reception of the radio-frequency signals (e.g., for performing unidirectional and/or bidirectional wireless communications with external wireless communications equipment). Antennas 40 may transmit the radio-frequency signals by radiating the radio-frequency signals into free space (or to freespace through intervening device structures such as a dielectric cover layer). Antennas 40 may additionally or alternatively receive the radio-frequency signals from free space (e.g., through intervening devices structures such as a dielectric cover layer). The transmission and reception of radio-frequency signals by antennas 40 each involve the excitation or resonance of antenna currents on an antenna resonating element in the antenna by the radio-frequency signals within the frequency band(s) of operation of the antenna.

In satellite navigation system links, cellular telephone links, and other long-range links, radio-frequency signals are typically used to convey data over thousands of feet or miles. In Wi-Fi® and Bluetooth® links at 2.4 and 5 GHz and other short-range wireless links, radio-frequency signals are typically used to convey data over tens or hundreds of feet. Millimeter/centimeter wave transceiver circuitry 38 may convey radio-frequency signals over short distances that travel over a line-of-sight path. To enhance signal reception for millimeter and centimeter wave communications, phased antenna arrays and beam steering techniques may be used (e.g., schemes in which antenna signal phase and/or magnitude for each antenna in an array are adjusted to perform beam steering). Antenna diversity schemes may also be used to ensure that the antennas that have become blocked or that are otherwise degraded due to the operating environment of device 10 can be switched out of use and higher-performing antennas used in their place.

Antennas 40 in wireless circuitry 34 may be formed using any suitable antenna types. For example, antennas 40 may include antennas with resonating elements that are formed from stacked patch antenna structures, loop antenna structures, patch antenna structures, inverted-F antenna structures, slot antenna structures, planar inverted-F antenna structures, monopole antenna structures, dipole antenna structures, helical antenna structures, Yagi (Yagi-Uda) antenna structures, hybrids of these designs, etc. In another suitable arrangement, antennas 40 may include antennas with dielectric resonating elements such as dielectric resonator antennas. If desired, one or more of antennas 40 may be cavity-backed antennas. Different types of antennas may be used for different bands and combinations of bands. For example, one type of antenna may be used in forming a non-millimeter/centimeter wave wireless link for non-millimeter/centimeter wave transceiver circuitry 36 and another type of antenna may be used in conveying radio-frequency signals at millimeter and/or centimeter wave frequencies for millimeter/centimeter wave transceiver circuitry 38. Antennas 40 that are used to convey radio-frequency signals at millimeter and centimeter wave frequencies may be arranged in one or more phased antenna arrays.

Figure 3:
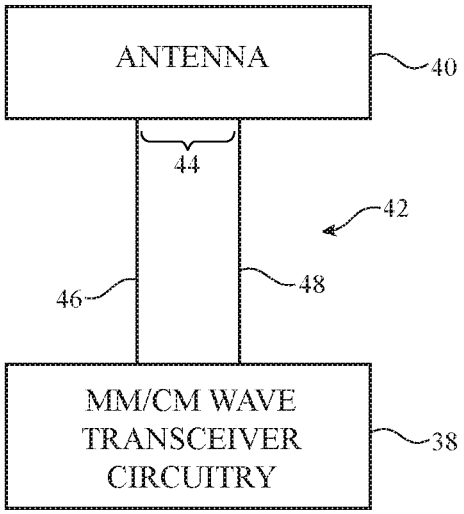
FIG. 3 is a schematic diagram of illustrative wireless circuitry in accordance with some embodiments.

A schematic diagram of an antenna 40 that may be formed in a phased antenna array for conveying radio-frequency signals at millimeter and centimeter wave frequencies is shown in FIG. 3. As shown in FIG. 3, antenna 40 may be coupled to millimeter/centimeter (MM/CM) wave transceiver circuitry 38. Millimeter/centimeter wave transceiver circuitry 38 may be coupled to antenna feed 44 of antenna 40 using a transmission line path that includes radio-frequency transmission line 42. Radio-frequency transmission line 42 may include a positive signal conductor such as signal conductor 46 and may include a ground conductor such as ground conductor 48. Ground conductor 48 may be coupled to the antenna ground for antenna 40 (e.g., over a ground antenna feed terminal of antenna feed 44 located at the antenna ground). Signal conductor 46 may be coupled to the antenna resonating element for antenna 40. For example, signal conductor 46 may be coupled to a positive antenna feed terminal of antenna feed 44 located at the antenna resonating element.

In another suitable arrangement, antenna 40 may be a probe-fed antenna that is fed using a feed probe. In this arrangement, antenna feed 44 may be implemented as a feed probe. Signal conductor 46 may be coupled to the feed probe. Radio-frequency transmission line 42 may convey radio-frequency signals to and from the feed probe. When radio-frequency signals are being transmitted over the feed probe and the antenna, the feed probe may excite the resonating element for the antenna (e.g., may excite electromagnetic resonant modes of a dielectric antenna resonating element for antenna 40). The resonating element may radiate the radio-frequency signals in response to excitation by the feed probe. Similarly, when radio-frequency signals are received by the antenna (e.g., from free space), the radio-frequency signals may excite the resonating element for the antenna (e.g., may excite electromagnetic resonant modes of the dielectric antenna resonating element for antenna 40). This may produce antenna currents on the feed probe and the corresponding radio-frequency signals may be passed to the transceiver circuitry over the radio-frequency transmission line.

Radio-frequency transmission line 42 may include a stripline transmission line (sometimes referred to herein simply as a stripline), a coaxial cable, a coaxial probe realized by metalized vias, a microstrip transmission line, an edge-coupled microstrip transmission line, an edge-coupled stripline transmission lines, a waveguide structure, combinations of these, etc. Multiple types of transmission lines may be used to form the transmission line path that couples millimeter/centimeter wave transceiver circuitry 38 to antenna feed 44. Filter circuitry, switching circuitry, impedance matching circuitry, phase shifter circuitry, amplifier circuitry, and/or other circuitry may be interposed on radio-frequency transmission line 42, if desired.

Radio-frequency transmission lines in device 10 may be integrated into ceramic substrates, rigid printed circuit boards, and/or flexible printed circuits. In one suitable arrangement, radio-frequency transmission lines in device 10 may be integrated within multilayer laminated structures (e.g., layers of a conductive material such as copper and a dielectric material such as a resin that are laminated together without intervening adhesive) that may be folded or bent in multiple dimensions (e.g., two or three dimensions) and that maintain a bent or folded shape after bending (e.g., the multilayer laminated structures may be folded into a particular three-dimensional shape to route around other device components and may be rigid enough to hold its shape after folding without being held in place by stiffeners or other structures). All of the multiple layers of the laminated structures may be batch laminated together (e.g., in a single pressing process) without adhesive (e.g., as opposed to performing multiple pressing processes to laminate multiple layers together with adhesive).

Figure 4:
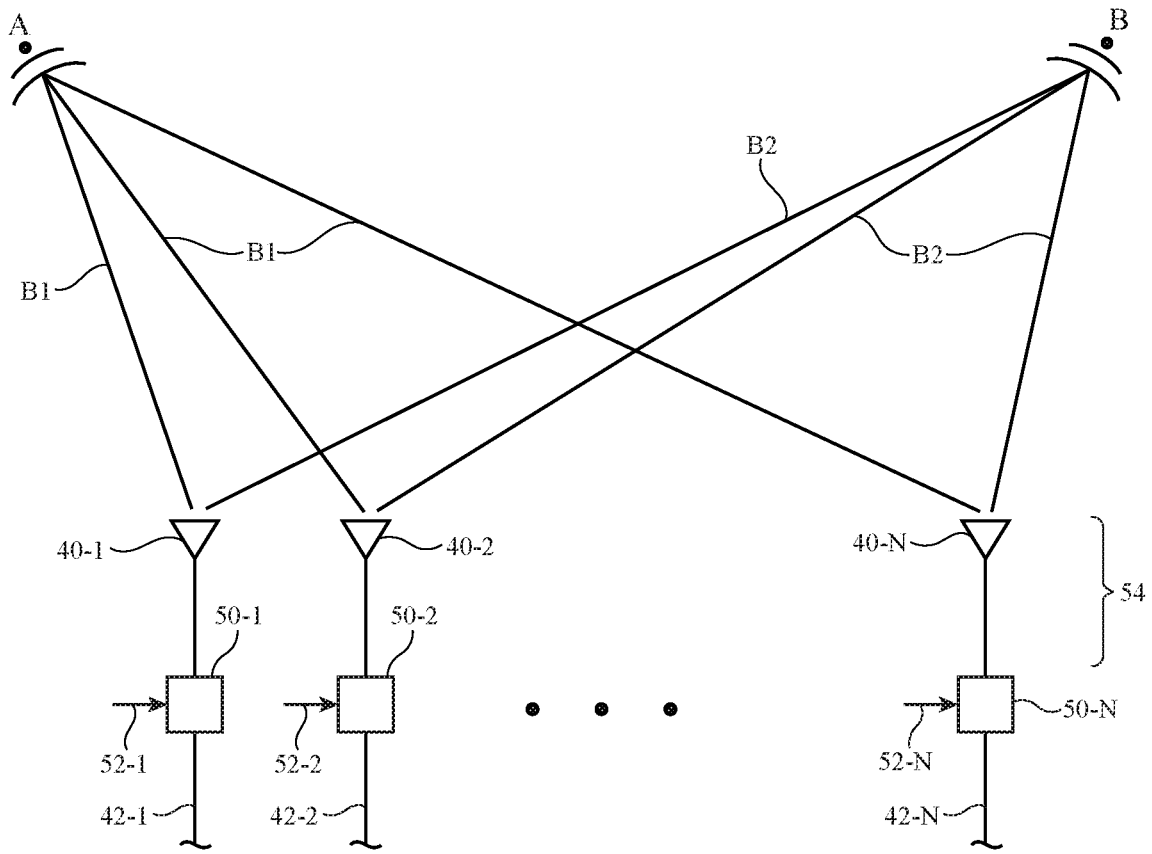
FIG. 4 is a diagram of an illustrative phased antenna array that may be adjusted using control circuitry to direct a beam of signals in accordance with some embodiments.

FIG. 4 shows how antennas 40 for handling radio-frequency signals at millimeter and centimeter wave frequencies may be formed in a phased antenna array. As shown in FIG. 4, phased antenna array 54 (sometimes referred to herein as array 54, antenna array 54, or array 54 of antennas 40) may be coupled to radio-frequency transmission lines 42. For example, a first antenna 40-1 in phased antenna array 54 may be coupled to a first radio-frequency transmission line 42-1, a second antenna 40-2 in phased antenna array 54 may be coupled to a second radio-frequency transmission line 42-2, an Nth antenna 40-N in phased antenna array 54 may be coupled to an Nth radio-frequency transmission line 42-N, etc. While antennas 40 are described herein as forming a phased antenna array, the antennas 40 in phased antenna array 54 may sometimes also be referred to as collectively forming a single phased array antenna.

Antennas 40 in phased antenna array 54 may be arranged in any desired number of rows and columns or in any other desired pattern (e.g., the antennas need not be arranged in a grid pattern having rows and columns). During signal transmission operations, radio-frequency transmission lines 42 may be used to supply signals (e.g., radio-frequency signals such as millimeter wave and/or centimeter wave signals) from millimeter/centimeter wave transceiver circuitry 38 (FIG. 3) to phased antenna array 54 for wireless transmission. During signal reception operations, radio-frequency transmission lines 42 may be used to supply signals received at phased antenna array 54 (e.g., from external wireless equipment or transmitted signals that have been reflected off of external objects) to millimeter/centimeter wave transceiver circuitry 38 (FIG. 3).

The use of multiple antennas 40 in phased antenna array 54 allows beam steering arrangements to be implemented by controlling the relative phases and magnitudes (amplitudes) of the radio-frequency signals conveyed by the antennas. In the example of FIG. 4, antennas 40 each have a corresponding radio-frequency phase and magnitude controller 50 (e.g., a first phase and magnitude controller 50-1 interposed on radio-frequency transmission line 42-1 may control phase and magnitude for radio-frequency signals handled by antenna 40-1, a second phase and magnitude controller 50-2 interposed on radio-frequency transmission line 42-2 may control phase and magnitude for radio-frequency signals handled by antenna 40-2, an Nth phase and magnitude controller 50-N interposed on radio-frequency transmission line 42-N may control phase and magnitude for radio-frequency signals handled by antenna 40-N, etc.).

Phase and magnitude controllers 50 may each include circuitry for adjusting the phase of the radio-frequency signals on radio-frequency transmission lines 42 (e.g., phase shifter circuits) and/or circuitry for adjusting the magnitude of the radio-frequency signals on radio-frequency transmission lines 42 (e.g., power amplifier and/or low noise amplifier circuits). Phase and magnitude controllers 50 may sometimes be referred to collectively herein as beam steering circuitry (e.g., beam steering circuitry that steers the beam of radio-frequency signals transmitted and/or received by phased antenna array 54).

Phase and magnitude controllers 50 may adjust the relative phases and/or magnitudes of the transmitted signals that are provided to each of the antennas in phased antenna array 54 and may adjust the relative phases and/or magnitudes of the received signals that are received by phased antenna array 54. Phase and magnitude controllers 50 may, if desired, include phase detection circuitry for detecting the phases of the received signals that are received by phased antenna array 54. The term "beam" or "signal beam" may be used herein to collectively refer to wireless signals that are transmitted and received by phased antenna array 54 in a particular direction. The signal beam may exhibit a peak gain that is oriented in a particular pointing direction at a corresponding pointing angle (e.g., based on constructive and destructive interference from the combination of signals from each antenna in the phased antenna array). The term "transmit beam" may sometimes be used herein to refer to radio-frequency signals that are transmitted in a particular direction whereas the term "receive beam" may sometimes be used herein to refer to radio-frequency signals that are received from a particular direction.

If, for example, phase and magnitude controllers 50 are adjusted to produce a first set of phases and/or magnitudes for transmitted radio-frequency signals, the transmitted signals will form a transmit beam as shown by beam B1 of FIG. 4 that is oriented in the direction of point A. If, however, phase and magnitude controllers 50 are adjusted to produce a second set of phases and/or magnitudes for the transmitted signals, the transmitted signals will form a transmit beam as shown by beam B2 that is oriented in the direction of point B. Similarly, if phase and magnitude controllers 50 are adjusted to produce the first set of phases and/or magnitudes, radio-frequency signals (e.g., radio-frequency signals in a receive beam) may be received from the direction of point A, as shown by beam B1. If phase and magnitude controllers 50 are adjusted to produce the second set of phases and/or magnitudes, radio-frequency signals may be received from the direction of point B, as shown by beam B2.

Each phase and magnitude controller 50 may be controlled to produce a desired phase and/or magnitude based on a corresponding control signal 52 received from control circuitry 28 of FIG. 2 (e.g., the phase and/or magnitude provided by phase and magnitude controller 50-1 may be controlled using control signal 52-1, the phase and/or magnitude provided by phase and magnitude controller 50-2 may be controlled using control signal 52-2, etc.). If desired, the control circuitry may actively adjust control signals 52 in real time to steer the transmit or receive beam in different desired directions over time. Phase and magnitude controllers 50 may provide information identifying the phase of received signals to control circuitry 28 if desired. A codebook on device 10 may map each beam pointing angle to a corresponding set of phase and magnitude values to be provided to phase and magnitude controllers 50 (e.g., the control circuitry may generate control signals 52 based on information from the codebook).

When performing wireless communications using radio-frequency signals at millimeter and centimeter wave frequencies, the radio-frequency signals are conveyed over a line of sight path between phased antenna array 54 and external communications equipment. If the external object is located at point A of FIG. 4, phase and magnitude controllers 50 may be adjusted to steer the signal beam towards point A (e.g., to steer the pointing direction of the signal beam towards point A). Phased antenna array 54 may transmit and receive radio-frequency signals in the direction of point A. Similarly, if the external communications equipment is located at point B, phase and magnitude controllers 50 may be adjusted to steer the signal beam towards point B (e.g., to steer the pointing direction of the signal beam towards point B). Phased antenna array 54 may transmit and receive radio-frequency signals in the direction of point B. In the example of FIG. 4, beam steering is shown as being performed over a single degree of freedom for the sake of simplicity (e.g., towards the left and right on the page of FIG. 4). However, in practice, the beam may be steered over two or more degrees of freedom (e.g., in three dimensions, into and out of the page and to the left and right on the page of FIG. 4). Phased antenna array 54 may have a corresponding field of view over which beam steering can be performed (e.g., in a hemisphere or a segment of a hemisphere over the phased antenna array). If desired, device 10 may include multiple phased antenna arrays that each face a different direction to provide coverage from multiple sides of the device.

Figure 5:
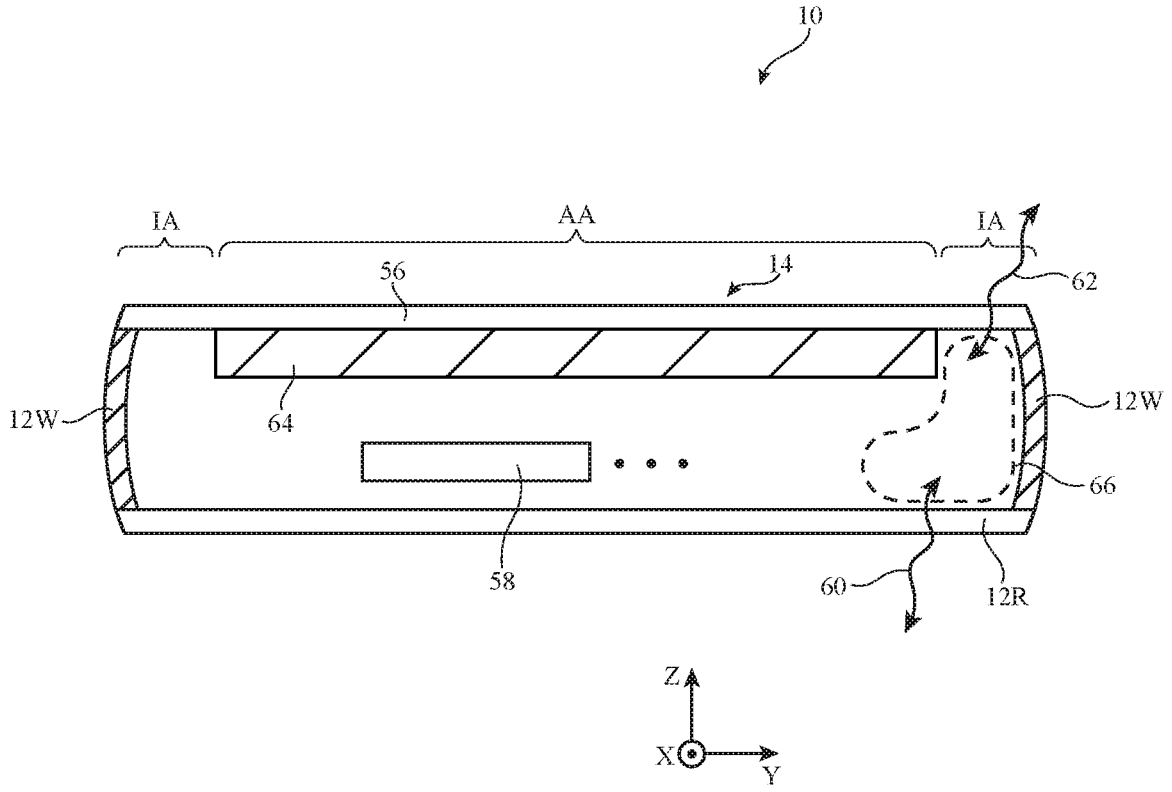
FIG. 5 is a cross-sectional side view of an illustrative electronic device having phased antenna arrays for radiating through different sides of the device in accordance with some embodiments.

FIG. 5 is a cross-sectional side view of device 10 in an example where device 10 has multiple phased antenna arrays. As shown in FIG. 5, peripheral conductive housing structures 12W may extend around the (lateral) periphery of device 10 and may extend from rear housing wall 12R to display 14. Display 14 may have a display module such as display module 64 (sometimes referred to as a display panel or conductive display structures). Display module 64 may include pixel circuitry, touch sensor circuitry, force sensor circuitry, and/or any other desired circuitry for forming active area AA of display 14. Display 14 may include a dielectric cover layer such as display cover layer 56 that overlaps display module 64. Display module 64 may emit image light and may receive sensor input through display cover layer 56. Display cover layer 56 and display 14 may be mounted to peripheral conductive housing structures 12W. The lateral area of display 14 that does not overlap display module 64 may form inactive area IA of display 14.

Device 10 may include multiple phased antenna arrays (e.g., phased antenna arrays 54 of FIG. 4). For example, device 10 may include a rear-facing phased antenna array. The rear-facing phased antenna array may be adhered to rear housing wall 12R using adhesive, may be pressed against (e.g., in contact with) rear housing wall 12R, or may be spaced apart from rear housing wall 12R. The rear-facing phased antenna array may transmit and/or receive radio-frequency signals 60 at millimeter and centimeter wave frequencies through rear housing wall 12R. In scenarios where rear housing wall 12R includes metal portions, radio-frequency signals 60 may be conveyed through an aperture or opening in the metal portions of rear housing wall 12R or may be conveyed through other dielectric portions of rear housing wall 12R. The aperture may be overlapped by a dielectric cover layer or dielectric coating that extends across the lateral area of rear housing wall 12R (e.g., between peripheral conductive housing structures 12W). The rear-facing phased antenna array may perform beam steering for radio-frequency signals 60 across at least some of the hemisphere below the rear face of device 10.

The field of view of the rear-facing phased antenna array is limited to the hemisphere under the rear face of device 10. Display module 64 and other components 58 (e.g., portions of input-output circuitry 24 or control circuitry 28 of FIG. 2, a battery for device 10, etc.) in device 10 include conductive structures. If care is not taken, these conductive structures may block radio-frequency signals from being conveyed by a phased antenna array within device 10 across the hemisphere over the front face of device 10. While a front-facing phased antenna array for covering the hemisphere over the front face of device 10 may be mounted against display cover layer 56 within inactive area IA, there may be insufficient space between the lateral periphery of display module 64 and peripheral conductive housing structures 12W to form all of the circuitry and radio-frequency transmission lines necessary to fully support the phased antenna array, particularly as the size of active area AA is maximized.

In order to mitigate these issues and provide coverage through the front face of device 10, a front-facing phased antenna array may be mounted within peripheral region 66 of device 10. The antennas in the front-facing phased antenna array may include dielectric resonator antennas. Dielectric resonator antennas may occupy less area in the X-Y plane of FIG. 5 than other types of antennas such as patch antennas and slot antennas. Implementing the antennas as dielectric resonator antennas may allow the radiating elements of the front-facing phased antenna array to fit within inactive area IA between display module 64 and peripheral conductive housing structures 12W. At the same time, the radio-frequency transmission lines and other components for the phased antenna array may be located behind (under) display module 64. The front-facing phased antenna array may transmit and/or receive radio-frequency signals 62 at millimeter and centimeter wave frequencies through display cover layer 56. The front-facing phased antenna array may perform beam steering for radio-frequency signals 62 across at least some of the hemisphere above the front face of device 10.

Device 10 may include both a front-facing phased antenna array (e.g., within peripheral region 66) and a rear-facing phased antenna array (e.g., within peripheral region 66 or elsewhere between display module 64 and rear housing wall 12R). If desired, device 10 may additionally or alternatively include one or more side-facing phased antenna arrays. The side-facing phased antenna arrays may be aligned with dielectric antenna windows in peripheral conductive housing structures 12W. The front, rear, and/or side-facing phased antenna arrays may be omitted if desired. The front and rear-facing phased antenna arrays (and optionally the side-facing phased antenna arrays) may collectively provide radio-frequency cover across an entire sphere around device 10.

The phased antenna array(s) 54 in device 10 may be formed in corresponding integrated antenna modules. Each antenna module may include a substrate such as a rigid printed circuit board substrate, a flexible printed circuit substrate, a plastic substrate, or a ceramic substrate, and one or more phased antenna arrays mounted to the substrate. Each antenna module may also include electronic components (e.g., radio-frequency components) that support the operations of the phased antenna array(s) therein. For example, each antenna module may include a radio-frequency integrated circuit (e.g., an integrated circuit chip) or other circuitry mounted to the corresponding substrate. Transmission line structures (e.g., radio-frequency signal traces), conductive vias, conductive traces, solder balls, or other conductive interconnect structures may couple the radio-frequency integrated circuit to each of the antennas in the phased antenna array(s) of the antenna module. The radio-frequency integrated circuit (RFIC) and/or other electronic components in the antenna module may include radio-frequency components such as amplifier circuitry, phase shifter circuitry (e.g., phase and magnitude controllers 50 of FIG. 4), and/or other circuitry that operates on radio-frequency signals. The rear-facing, front-facing, and/or side-facing phased antenna array(s) in device 10 may be formed within respective antenna modules. In another suitable arrangement, a rear-facing and front-facing phased antenna array may be formed as a part of the same antenna module in device 10.

Figure 6:
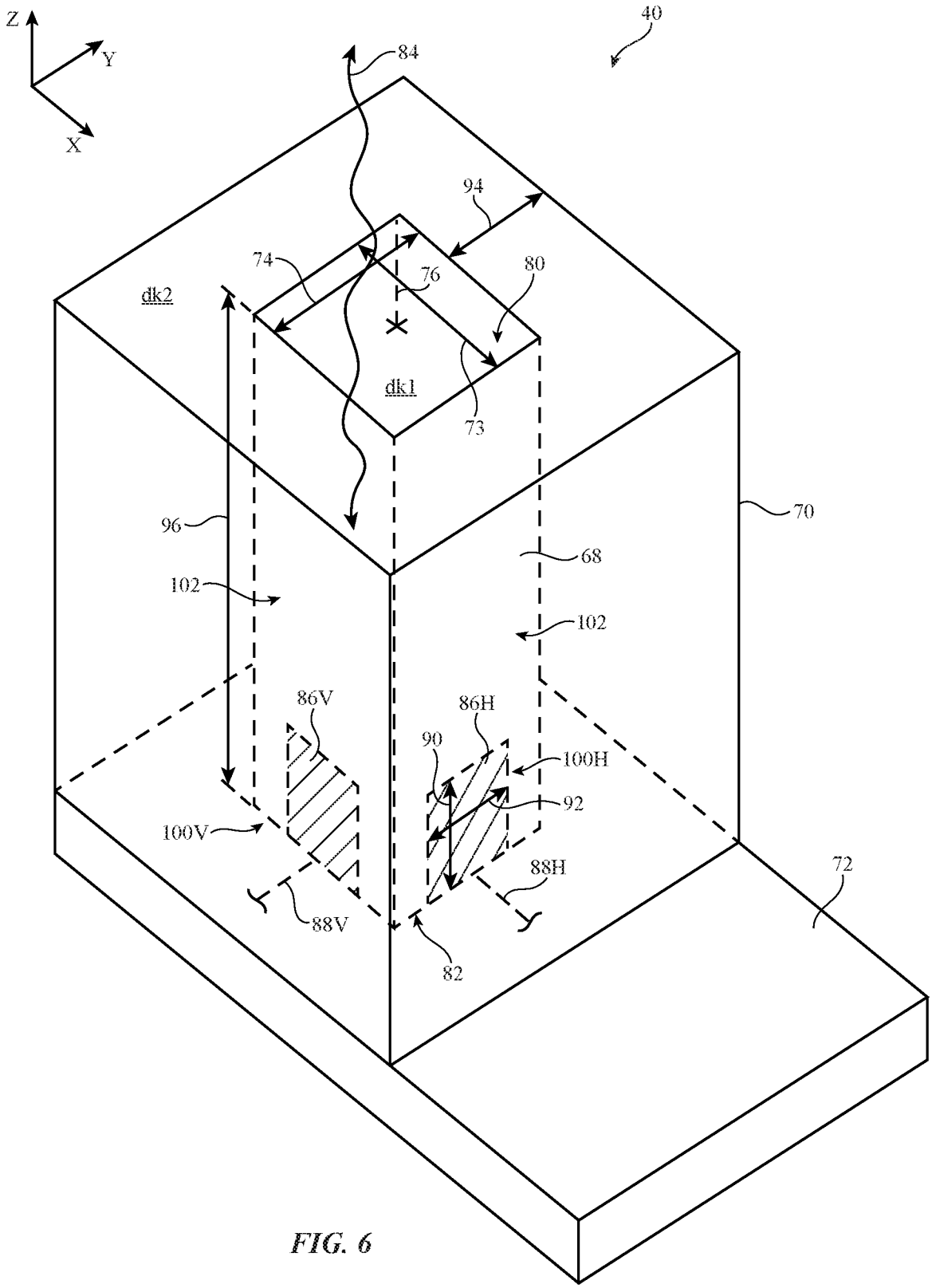
FIG. 6 is a perspective view of an illustrative prob-fed dielectric resonator antenna for covering multiple polarizations in accordance with some embodiments.

FIG. 6 is a perspective view of an illustrative probe-fed dielectric resonator antenna that may be used in forming the antennas of any of the phased antenna arrays in device 10. Antenna 40 of FIG. 6 may be a dielectric resonator antenna. In this example, antenna 40 includes a dielectric resonating element 68 mounted to an underlying substrate such as substrate 72. Substrate 72 may, for example, be the substrate of a corresponding antenna module in device 10. Substrate 72 may be a rigid printed circuit board substrate, a flexible printed circuit substrate, a ceramic substrate, a plastic substrate, or any other desired substrate.

In the example of FIG. 6, antenna 40 is a dual-polarization antenna that conveys both vertically and horizontally polarized radio-frequency signals 84 (e.g., linearly-polarized signals having orthogonal electric field orientations). This example is merely illustrative and, in another suitable arrangement, antenna 40 may only cover a single polarization. Antenna 40 may be fed using radio-frequency transmission lines that are formed on and/or embedded within flexible substrate 72 such as radio-frequency transmission lines 88 (e.g., a first radio-frequency transmission line 88V for conveying vertically-polarized signals and a second radio-frequency transmission line 88H for conveying horizontally-polarized signals). Radio-frequency transmission lines 88V and 88H may, for example, form part of radio-frequency transmission lines 42 of FIGS. 3 and 4. Radio-frequency transmission lines 88V and 88H may include ground traces (e.g., for forming part of ground conductor 48 of FIG. 3) and signal traces (e.g., for forming part of signal conductor 46 of FIG. 3) on and/or embedded within substrate 72. Radio-frequency transmission lines 88V and 88H may be coupled to a radio-frequency integrated circuit or other radio-frequency components on the antenna module that includes antenna 40.

Dielectric resonating element 68 of antenna 40 may be formed from a column (pillar) of dielectric material mounted to the top surface of substrate 72. If desired, dielectric resonating element 68 may be embedded within (e.g., laterally surrounded by) a dielectric substrate mounted to the top surface of substrate 72 such as dielectric substrate 70. Dielectric resonating element 68 may have a height 96 that extends from a bottom surface 82 at substrate 72 to an opposing top surface 80. Dielectric substrate 70 (sometimes referred to herein as over-mold structure 70) may extend across some or all of height 96. Top surface 80 may lie flush with the top surface of dielectric substrate 70, may protrude beyond the top surface of dielectric substrate 70, or dielectric substrate 70 may extend over and cover top surface 80 of dielectric resonating element 68.

The operating (resonant) frequency of antenna 40 may be selected by adjusting the dimensions of dielectric resonating element 68 (e.g., in the direction of the X, Y, and/or Z axes of FIG. 6). Dielectric resonating element 68 may be formed from a column of dielectric material having dielectric constant dk1. Dielectric constant dk1 may be relatively high (e.g., greater than 10.0, greater than 12.0, greater than 15.0, greater than 20.0, between 22.0 and 25.0, between 15.0 and 40.0, between 10.0 and 50.0, between 18.0 and 30.0, between 12.0 and 45.0, etc.). In one suitable arrangement, dielectric resonating element 68 may be formed from zirconia or a ceramic material. Other dielectric materials may be used to form dielectric resonating element 68 if desired.

Dielectric substrate 70 may be formed from a material having dielectric constant dk2. Dielectric constant dk2 may be less than dielectric constant dk1 of dielectric resonating element 68 (e.g., less than 18.0, less than 15.0, less than 10.0, between 3.0 and 4.0, less than 5.0, between 2.0 and 5.0, etc.). Dielectric constant dk2 may be less than dielectric constant dk1 by at least 10.0, 5.0, 15.0, 12.0, 6.0, etc. In one suitable arrangement, dielectric substrate 70 may be formed from molded plastic (e.g., injection molded plastic). Other dielectric materials may be used to form dielectric substrate 70 or dielectric substrate 70 may be omitted if desired. The difference in dielectric constant between dielectric resonating element 68 and dielectric substrate 70 may establish a radio-frequency boundary condition between dielectric resonating element 68 and dielectric substrate 70 from bottom surface 82 to top surface 80. This may configure dielectric resonating element 68 to serve as a resonating waveguide for propagating radio-frequency signals 84 at millimeter and centimeter wave frequencies.

Dielectric substrate 70 may have a width (thickness) 94 on some or all sides of dielectric resonating element 68. Width 94 may be selected to isolate dielectric resonating element 68 from surrounding device structures and/or from other dielectric resonating elements in the same antenna module and to minimize signal reflections in dielectric substrate 70. Width 94 may be, for example, at least one-tenth of the effective wavelength of the radio-frequency signals in a dielectric material of dielectric constant dk2. Width 94 may be 0.4-0.5 mm, 0.3-0.5 mm, 0.2-0.6 mm, greater than 0.1 mm, greater than 0.3 mm, 0.2-2.0 mm, 0.3-1.0 mm, or greater than between 0.4 and 0.5 mm, just as a few examples.

Dielectric resonating element 68 may radiate radio-frequency signals 84 when excited by the signal conductor for radio-frequency transmission lines 88V and/or 88H. In some scenarios, a slot is formed in ground traces on substrate 72, the slot is indirectly fed by a signal conductor embedded within substrate 72, and the slot excites dielectric resonating element 68 to radiate radio-frequency signals 84. However, in these scenarios, the radiating characteristics of the antenna may be affected by how the dielectric resonating element is mounted to substrate 72. For example, air gaps or layers of adhesive used to mount the dielectric resonating element to the flexible printed circuit can be difficult to control and can undesirably affect the radiating characteristics of the antenna. In order to mitigate the issues associated with exciting dielectric resonating element 68 using an underlying slot, antenna 40 may be fed using one or more radio-frequency feed probes 100 such as feed probes 100V and 100H of FIG. 6. Feed probes 100 may form part of the antenna feeds for antenna 40 (e.g., antenna feed 44 of FIG. 3).

As shown in FIG. 6, feed probe 100V may be formed from conductive structure 86V and feed probe 100H may be formed from conductive structure 86H. Conductive structure 86V may include a first portion patterned onto or pressed against a first sidewall 102 of dielectric resonating element 68. If desired, conductive structure 86V may also include a second portion on the surface of substrate 72 and the second portion may be coupled to the signal traces of radio-frequency transmission line 88V (e.g., using solder, welds, conductive adhesive, etc.). The second portion of conductive structure 86V may be omitted if desired (e.g., the signal traces in radio-frequency transmission line 88V may be soldered directly to the portion of conductive structure 86V on the first sidewall 102). Conductive structure 86V may include conductive traces patterned directly onto the first sidewall 102 or may include stamped sheet metal in scenarios where conductive structure 86V is pressed against the first sidewall 102, as examples.

The signal traces in radio-frequency transmission line 88V may convey radio-frequency signals to and from feed probe 100V. Feed probe 100V may electromagnetically couple the radio-frequency signals on the signal traces of radio-frequency transmission line 88V into dielectric resonating element 68. This may serve to excite one or more electromagnetic modes (e.g., radio-frequency cavity or waveguide modes) of dielectric resonating element 68. When excited by feed probe 100V, the electromagnetic modes of dielectric resonating element 68 may configure the dielectric resonating element to serve as a waveguide that propagates the wavefronts of radio-frequency signals 84 along the height of dielectric resonating element 68 (e.g., in the direction of the Z-axis and along the central/longitudinal axis 76 of dielectric resonating element 68). The radio-frequency signals 84 conveyed by feed probe 100V may be vertically polarized.

Similarly, conductive structure 86H may include a first portion patterned onto or pressed against a second sidewall 102 of dielectric resonating element 68. If desired, conductive structure 86H may also include a second portion on the surface of substrate 72 and the second portion may be coupled to the signal traces of radio-frequency transmission line 88H (e.g., using solder, welds, conductive adhesive, etc.). The second portion of conductive structure 86H may be omitted if desired (e.g., the signal traces in radio-frequency transmission line 88H may be soldered directly to the conductive structure 86H on sidewall 102). Conductive structure 86H may include conductive traces patterned directly onto the second sidewall 102 or may include stamped sheet metal in scenarios where conductive structure 86H is pressed against the second sidewall 102, as examples.

The signal traces in radio-frequency transmission line 88H may convey radio-frequency signals to and from feed probe 100H. Feed probe 100H may electromagnetically couple the radio-frequency signals on the signal traces of radio-frequency transmission line 88H into dielectric resonating element 68. This may serve to excite one or more electromagnetic modes (e.g., radio-frequency cavity or waveguide modes) of dielectric resonating element 68. When excited by feed probe 100H, the electromagnetic modes of dielectric resonating element 68 may configure the dielectric resonating element to serve as a waveguide that propagates the wavefronts of radio-frequency signals 84 along the height of dielectric resonating element 68 (e.g., along central/longitudinal axis 76 of dielectric resonating element 68). The radio-frequency signals 84 conveyed by feed probe 100H may be horizontally polarized.

Similarly, during signal reception, radio-frequency signals 84 may be received by antenna 40. The received radio-frequency signals may excite the electromagnetic modes of dielectric resonating element 68, resulting in the propagation of the radio-frequency signals down the height of dielectric resonating element 68. Feed probe 100V may couple the received vertically-polarized signals onto radio-frequency transmission line 88V. Feed probe 100H may couple the received horizontally-polarized signals onto radio-frequency transmission line 88H. Radio-frequency transmission lines 88H and 88V may pass the received radio-frequency signals to millimeter/centimeter wave transceiver circuitry (e.g., millimeter/centimeter wave transceiver circuitry 38 of FIGS. 2 and 3) through the radio-frequency integrated circuit for antenna 40. The relatively large difference in dielectric constant between dielectric resonating element 68 and dielectric substrate 70 may allow dielectric resonating element 68 to convey radio-frequency signals 84 with a relatively high antenna efficiency (e.g., by establishing a strong boundary between dielectric resonating element 68 and dielectric substrate 70 for the radio-frequency signals). The relatively high dielectric constant of dielectric resonating element 68 may also allow the dielectric resonating element 68 to occupy a relatively small volume compared to scenarios where materials with a lower dielectric constant are used.

The dimensions of feed probes 100V and 100H (e.g., height 90 and width 92 on sidewalls 102) may be selected to help match the impedance of radio-frequency transmission lines 88V and 88H to the impedance of dielectric resonating element 68. As an example, width 92 may be between 0.3 mm and 0.7 mm, between 0.2 mm and 0.8 mm, between 0.4 mm and 0.6 mm, or other values. Height 90 may be between 0.3 mm and 0.7 mm, between 0.2 mm and 0.8 mm, between 0.4 mm and 0.6 mm, or other values. Height 90 may be equal to width 92 or may be different than width 92. Feed probes 100V and 100H may sometimes be referred to herein as feed conductors, feed patches, or probe feeds. Dielectric resonating element 68 may sometimes be referred to herein as a dielectric radiating element, dielectric radiator, dielectric resonator, dielectric antenna resonating element, dielectric column, dielectric pillar, radiating element, or resonating element. When fed by one or more feed probes such as feed probes 100V and 100H, dielectric resonator antennas such as antenna 40 of FIG. 6 may sometimes be referred to herein as probe-fed dielectric resonator antennas.

Antenna 40 may be included in a rear-facing, front-facing, or side-facing phased antenna array in device 10 (e.g., radio-frequency signals 84 may form radio-frequency signals 62 or 60 of FIG. 5). In scenarios where antenna 40 is formed in a front-facing phased antenna array, top surface 80 may be pressed against, adhered to, or separated from display cover layer 56 of FIG. 5. In scenarios where antenna 40 is formed in a rear-facing phased antenna array, top surface 80 may be pressed against, adhered to, or separated from rear housing wall 12R of FIG. 5. An optional impedance matching layer may be interposed between top surface 80 and rear housing wall 12R or display cover layer 56. The impedance matching layer may have a dielectric constant that is between dielectric constant dk1 and the dielectric constant of rear housing wall 12R or display cover layer 56. If desired, the dielectric constant and thickness of the impedance matching layer may be selected to configure the impedance matching layer to form a quarter-wave impedance transformer for antenna 40 at the frequencies of operation of antenna 40. This may configure the impedance matching layer to help minimize signal reflections at the interfaces between top surface 80 and free space exterior to device 10.

If desired, radio-frequency transmission lines 88V and 88H may include impedance matching structures (e.g., transmission line stubs) to help match the impedance of dielectric resonating element 68. Both feed probes 100H and 100V may be active at once so that antenna 40 conveys both vertically and horizontally polarized signals at any given time. If desired, the phases of the signals conveyed by feed probes 100H and 100V may be independently adjusted so that antenna 40 conveys radio-frequency signals 84 with an elliptical or circular polarization. In another suitable arrangement, a single one of feed probes 100H and 100V may be active at once so that antenna 40 conveys radio-frequency signals of only a single polarization at any given time. In another suitable arrangement, antenna 40 may be a single-polarization antenna where radio-frequency transmission line 88V and feed probe 100V have been omitted.

As shown in FIG. 6, dielectric resonating element 68 may have a height 96, a length 74, and a width 73. Length 74, width 73, and height 96 may be selected to provide dielectric resonating element 68 with a corresponding mix of electromagnetic cavity/waveguide modes that, when excited by feed probes 100H and/or 100V, configure antenna 40 to radiate at desired frequencies. For example, height 96 may be 2-10 mm, 4-6 mm, 3-7 mm, 4.5-5.5 mm, or greater than 2 mm. Width 73 and length 74 may each be 0.5-1.0 mm, 0.4-1.2 mm, 0.7-0.9 mm, 0.5-2.0 mm, 1.5 mm-2.5 mm, 1.7 mm-1.9 mm, 1.0 mm-3.0 mm, etc. Width 73 may be equal to length 74 (e.g., dielectric resonating element 68 may have a square-shaped lateral profile in the X-Y plane) or, in other arrangements, may be different than length 74 (e.g., dielectric resonating element 68 may have a rectangular or non-rectangular lateral profile in the X-Y plane). Sidewalls 102 of dielectric resonating element 68 may directly contact the surrounding dielectric substrate 70. Dielectric substrate 70 may be molded over feed probes 100H and 100V or may include openings, notches, or other structures that accommodate the presence of feed probes 100H and 100V. Each sidewall 102 may be planar or, if desired, one or more sidewall 102 may have a non-planar shape (e.g., a shape with planar and curved portions, a planar shape with a notch or recessed portion, etc.). The example of FIG. 6 is merely illustrative and, if desired, dielectric resonating element 68 may have other shapes (e.g., shapes with any desired number of straight and/or curved sidewalls 102).

If desired, antenna 40 in FIG. 6 may include any other suitable elements. As an example, in order to mitigate cross polarization interference, parasitic elements onto the sidewalls of dielectric resonating element 68. These parasitic elements may, for example, be formed from floating patches of conductive material patterned onto or pressed against the sidewalls of dielectric resonating element 68 (e.g., conductive patches that are not coupled to ground or the signal traces for antenna 40). In an illustrative arrangement, a first parasitic element may be patterned onto or pressed against a sidewall of dielectric resonating element 68 opposite feed probe 100H (e.g., opposite the sidewall at which feed probe 100H is disposed), and a second parasitic element may be patterned onto or pressed against a sidewall of dielectric resonating element 68 opposite feed probe 100V (e.g., opposite the sidewall at which feed probe 100V is disposed).

Phased antenna array 54 of FIG. 4 (e.g., a front-facing phased antenna array for conveying radio-frequency signals 62 through display cover layer 56 of FIG. 5, a rear-facing phased antenna array for conveying radio-frequency signals 60 through rear housing wall 12R of FIG. 5, or a side-facing phased antenna array) may include any desired number of antennas 40 arranged in any desired pattern (e.g., a pattern having rows and columns). Each of the antennas 40 in phased antenna array 54 may be dielectric resonator antenna such as the probe-fed dielectric resonator antenna 40 of FIG. 6 (e.g., having two feed probes 100V and 100H as shown in FIG. 6, optionally with parasitic elements). Phased antenna array 54 may be formed as a part of an integrated antenna module.

Figure 7:
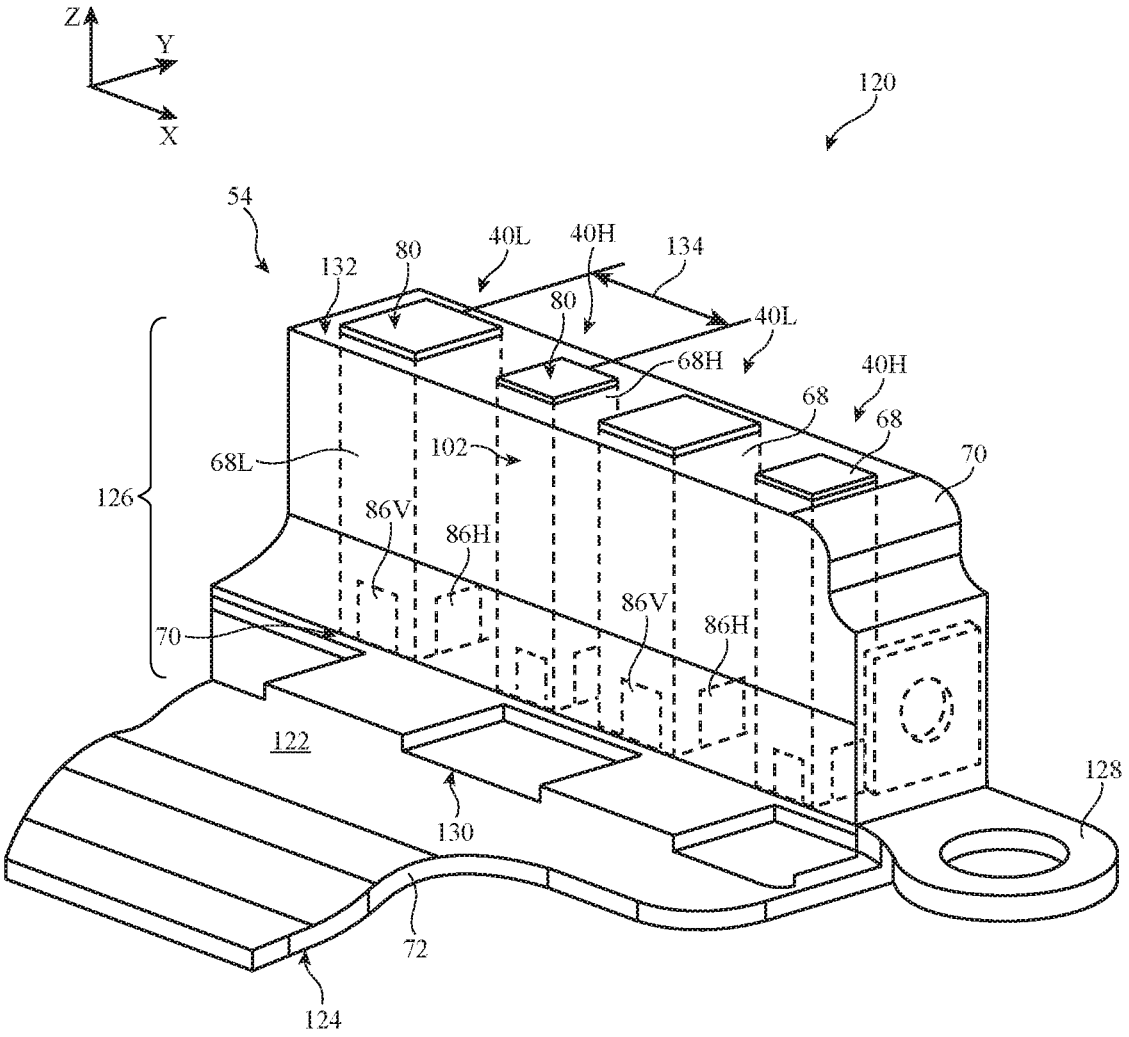
FIG. 7 is a perspective view of an illustrative antenna module having dielectric resonator antennas with feed probes in accordance with some embodiments.

FIG. 7 is a perspective view of an illustrative integrated antenna module that may include phased antenna array 54. In the example of FIG. 7, substrate 72 is a flexible printed circuit. Phased antenna array 54 may include multiple dielectric resonating elements 68 embedded within dielectric substrate 70 to form antenna package 126. Substrate 72 may include top and bottom opposing surfaces 122 and 124. Antenna package 126 may be mounted on surface 122 of substrate 72 (e.g., may be surface-mounted to contact pads on surface 122). In the example of FIG. 7, phased antenna array 54 includes two low band antennas 40L interleaved with two high band antennas 40H (e.g., in a 1×4 array). This is merely illustrative and, in general, phased antenna array 54 may include any desired number of antennas for covering any desired frequency bands. The antennas may be arranged in any desired pattern.

As shown in FIG. 7, the dielectric resonating element 68H in high band antennas 40H may be separated from the dielectric resonating element 68L in one or two adjacent low band antennas 40L by distance 134. Distance 134 may be selected to provide satisfactory electromagnetic isolation between low band antennas 40L and high band antennas 40H. Each dielectric resonating element 68 in phased antenna array 54 may be fed by feed probes having conductive structures 86V and 86H. Conductive structures 86V and 86H may be pressed against corresponding dielectric resonating elements 68 by feed probe biasing structures in antenna package 126 (not shown in FIG. 7 for the sake of clarity). The feed probe biasing structures may, for example, press or bias conductive structure 86H against the sidewalls 102 of dielectric resonating elements 68 (e.g., by exerting a biasing force in the −X direction). Similarly, the feed probe biasing structures may press or bias conductive structure 86V against the sidewalls 102 of dielectric resonating elements 68 (e.g., by exerting a biasing force in the +Y direction).

Dielectric substrate 70 may be molded over the feed probe biasing structures as well as dielectric resonating elements 68. Dielectric substrate 70 may have a bottom surface 130 at substrate 72 and an opposing top surface 132. In the example of FIG. 7, the top surface 80 of dielectric resonating elements 68 protrudes above top surface 132 of dielectric substrate 70. This is merely illustrative and, if desired, top surface 132 may lie flush with the top surface 80. In another suitable arrangement, dielectric substrate 70 may cover the top surface 80 of dielectric resonating elements 70. An attachment structure 128 may be partially embedded within dielectric substrate 70 (e.g., dielectric substrate 70 may be molded over part of attachment structure 128). Attachment structure 128 may help to secure antenna module 120 in place within device 10 if desired (e.g., using screws, pins, or other structures that extend through an opening in attachment structure 128).

Figure 8:
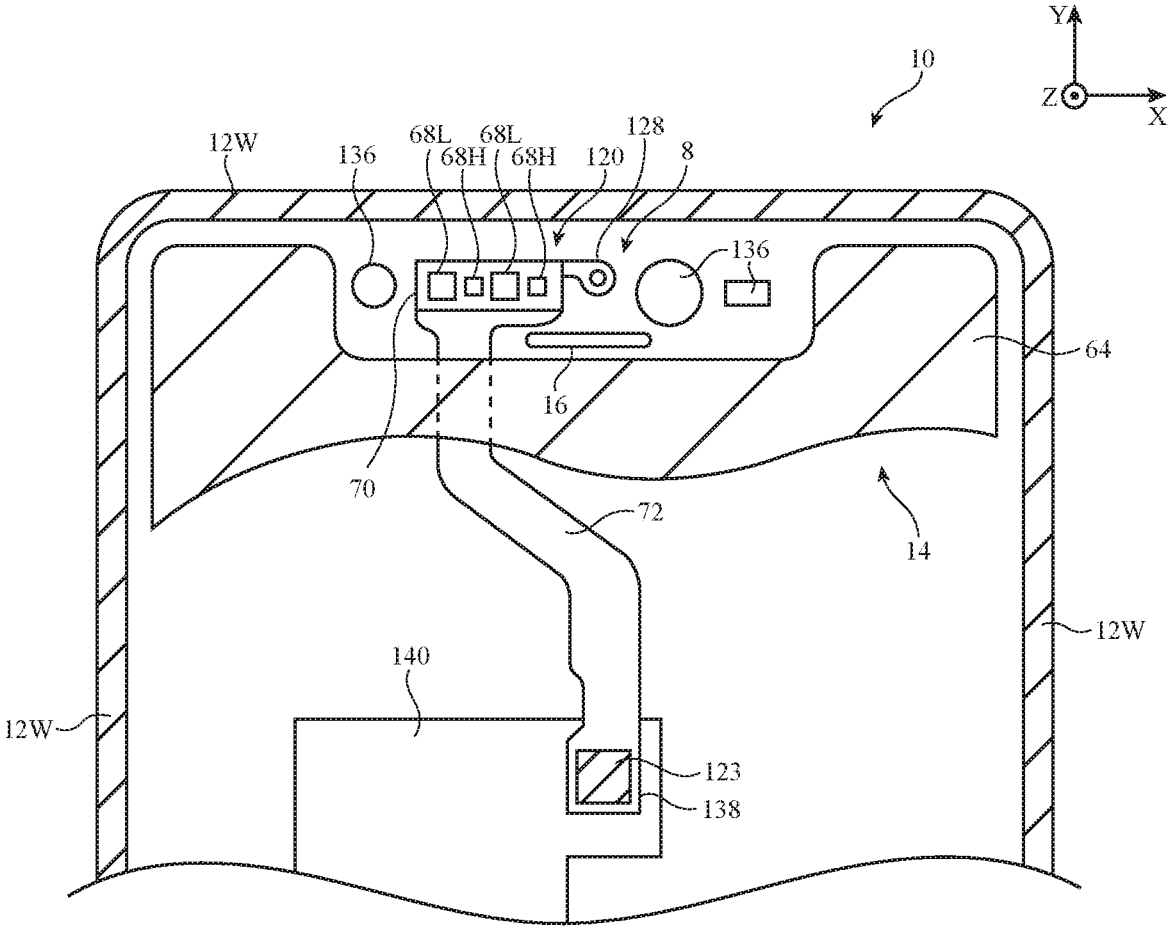
FIG. 8 is a top-down view of an illustrative electronic device having an antenna module aligned with a notch in a display module in accordance with some embodiments.

FIG. 8 is a top-down view showing one illustrative location where antenna module 120 may be mounted within device 10 (e.g., antenna module 120 of FIG. 7). As shown in FIG. 8, display module 64 in display 14 may include notch 8. Display cover layer 56 of FIG. 5 has been omitted from FIG. 8 for the sake of clarity. Display module 64 may form active area AA of display 14 whereas notch 8 forms part of inactive area IA of display 14 (FIG. 1). The edges of notch 8 may be defined by peripheral conductive housing structures 12W and display module 64. For example, notch 8 may have two or more edges (e.g., three edges) defined by display module 64 and one or more edges defined by peripheral conductive housing structures 12W.

Device 10 may include speaker port 16 (e.g., an ear speaker) within notch 8. If desired, device 10 may include other components 136 within notch 8. Other components 136 may include one or more image sensors such as one or more cameras, an infrared image sensor, an infrared light emitter (e.g., an infrared dot projector and/or flood illuminator), an ambient light sensor, a fingerprint sensor, a capacitive proximity sensor, a thermal sensor, a moisture sensor, or any other desired input/output components (e.g., input/output devices 26 of FIG. 2). Antenna module 120 (e.g., an antenna module having dielectric resonating elements 68L interleaved with dielectric resonating elements 68H for covering different frequency bands) may be mounted within device 10 (e.g., within peripheral region 66 of FIG. 5) and aligned with the portion(s) of notch 8 that are not occupied by other components 136 or speaker port 16. Antenna module 120 may be laterally interposed between two components 136 such as between an image sensor (e.g., a rear-facing camera) and an ambient light sensor, dot projector, flood illuminator, or ambient light sensor, for example.

Substrate 72 may extend under display module 64 to another substrate such as substrate 140 (e.g., another flexible printed circuit, a rigid printed circuit board, a main logic board, etc.). The radio-frequency transceiver circuitry (e.g., transceiver circuitry 38 in FIGS. 2 and 3) for antenna module 120 may be mounted to substrate 140 if desired. Connector 123 (e.g. a board-to-board connector) on substrate 72 may be coupled to connector 138 (e.g., a board-to-board connector) on substrate 140. The example of FIG. 21 is merely illustrative and, in general, antenna module 120 may be mounted at any desired location within device 10. Antenna module 120 may have any desired number of antennas for covering any desired frequency bands. The antennas in antenna module 120 may be arranged in any desired one or two-dimensional pattern.

By incorporating an antenna module such as antenna module 120 in the configuration shown in FIG. 8, antennas in antenna module 120 may cover at least some of the hemisphere over the front face of device 10 without occupying an excessive amount of space within device 10. However, configured in this manner, antennas in antenna module 120 may be disposed in close proximity to other wireless communication circuitry (e.g., other antennas) and other components in device 10. If care is not taken, these antennas and their corresponding elements may undesirably interfere with each other's operations.

Figure 9:
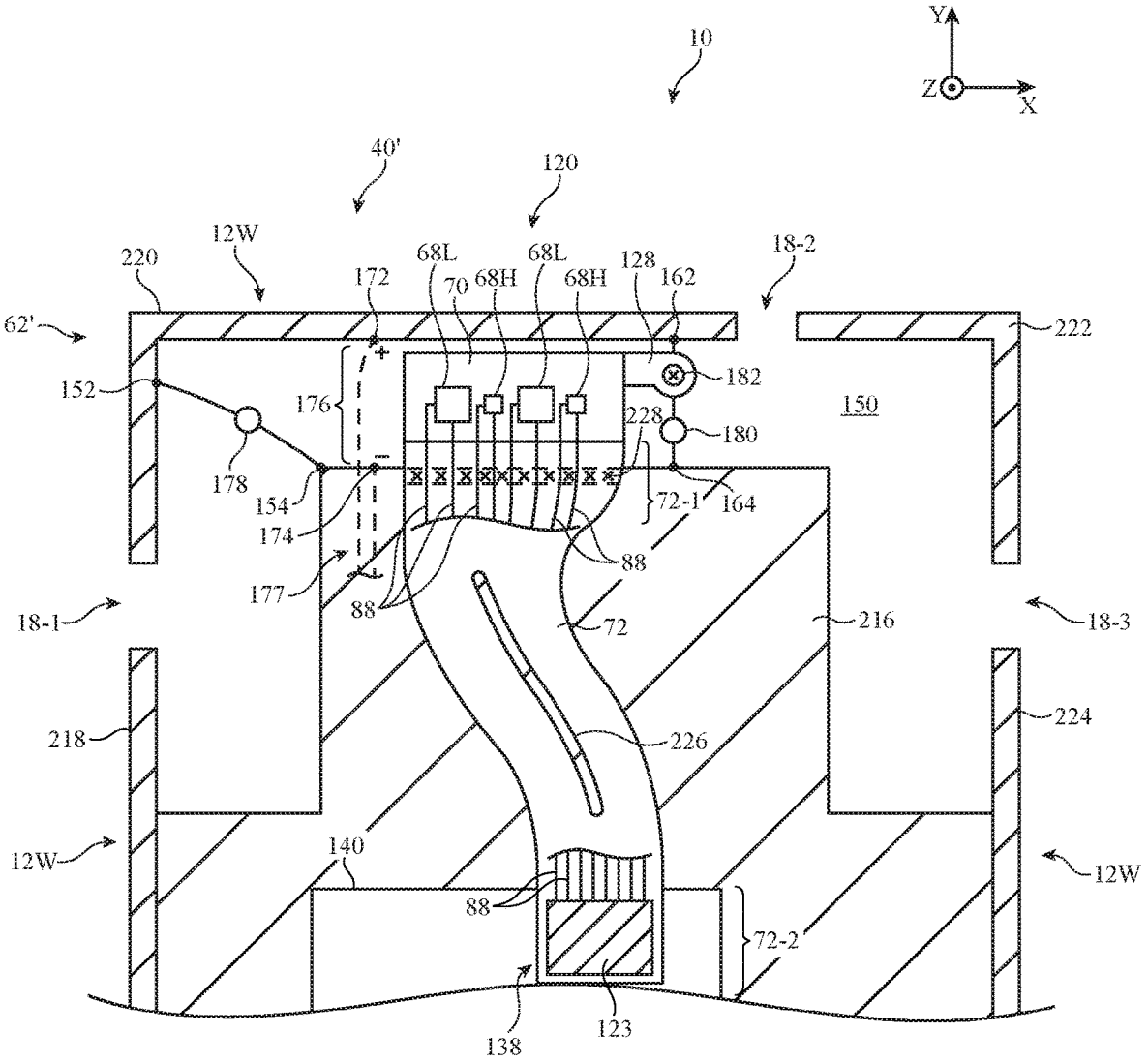
FIG. 9 is a top-down view of an illustrative electronic device having an antenna module coupled to a slotted printed circuit and integrated with additional antenna elements in accordance with some embodiments.

FIG. 9 is top view of an illustrative configuration of device 10 having antennas in antenna module 120 (e.g., antennas 40L and antennas 40H in FIG. 7) in close proximity to (e.g., adjacent to) antenna 40'. As shown in FIG. 9, device 10 may have peripheral conductive housing structures 12W. Peripheral conductive housing structures 12W may be divided by dielectric-filed peripheral gaps 18 (e.g., plastic gaps) such as gaps 18-1, 18-2, 18-3. Gap 18-1 may divide peripheral conductive housing structures 12W into segment 218 and segment 220. Gap 18-2 may separate segment 220 from segment 222 of peripheral conductive housing structures 12W. Gap 18-3 may separate segment 222 from segment 224 of peripheral conductive housing structures 12W.

As shown in FIG. 9, device 10 may include multiple antennas 40 such as antenna 40', antennas 40L (in module 120), antennas 40H (in module 120), and other antennas. If desired, these antennas may share ground structures 216, which form at a portion of the antenna ground (e.g., the antenna ground coupled to ground connector 48 in FIG. 3) for the antennas.

Ground structures 216 may be formed from conductive housing structures, from electrical device components in device 10, from printed circuit board traces, from strips of conductor such as strips of wire and metal foil, from conductive portions of display 14 (FIG. 1), and/or other conductive structures. In one suitable arrangement, ground structures 216 may include conductive portions of housing 12 (e.g., portions of rear housing wall 12R of FIG. 1 and/or portions of a different conductive support plate in device 10) and conductive portions of display 14 (FIG. 1). Segments 218 and 224 of peripheral conductive housing structures 12W may be coupled to ground structures 216 and may therefore form part of the antenna ground for one or more antennas in device 10. Segments 218 and 224 and ground structures 216 may be formed from a single integral piece of metal if desired.

Segments 220 and 222 of peripheral conductive housing structures 12W may be separated from ground structures 216 by dielectric-filled slot 150. Air, plastic, ceramic, glass, and/or other dielectric materials may fill slot 150. In one suitable arrangement, slot 150 may be continuous with gaps 18-1, 18-2, and 18-3, and a single piece of dielectric material (e.g., plastic) may fill slot 150, gap 18-1, gap 18-2, and gap 18-3. Dielectric material in slot 150 may lie flush with the exterior surface of device 10 if desired.

Antennas 40', 40L, and 40H may be coupled to transceiver circuitry (e.g., corresponding transceiver circuitry 36 and/or 38) by corresponding radio-frequency transmission line paths (e.g., path 177 for antenna 40' and paths 88 for antennas 40L and 40H). The transceiver circuitry may be mounted to a substrate such as logic board 140. Logic board 140 may include a rigid printed circuit board, a flexible printed circuit, an integrated circuit, an integrated circuit package, and/or any other desired substrates. If desired, different transceiver circuitry (e.g., transceiver circuitry 36 and 38) may be mounted to different substrates. Filter circuitry, switching circuitry, or any other desired radio-frequency circuitry (not shown in FIG. 9 for the sake of clarity) may be interposed on the radio-frequency transmission line paths between the corresponding transceiver circuitry and the antennas in device 10.

Antenna 40' may have an antenna resonating element 68' that includes one or more antenna resonating element arms (e.g., a high band arm and a low band arm) formed from segment 220 of peripheral conductive housing structures 12W. The length of segment 220 may be selected to provide antenna 40' with response peaks in one or more communications bands. Antenna 40' may have an antenna feed 176 with a positive antenna feed terminal 172 coupled to segment 220 and a ground antenna feed terminal 174 coupled to ground structures 216. The length of segment 220 from antenna feed 176 to gap 18-1 and/or the length of segment 220 from antenna feed 176 to gap 18-2 may, for example, be approximately equal to one-quarter of an effective wavelength of operation of antenna 40' (e.g., where the effective wavelength is equal to the free space wavelength modified by a constant value determined by the dielectric material in slot 106). Antenna 40' may also have one or more harmonic modes and/or parasitic elements that cover additional frequencies. Slot 150 may also be a radiating slot that contributes to the frequency response of antenna 40' (e.g., antenna 40' may be a hybrid inverted-F slot antenna).

In the example of FIG. 9, antenna 40' may operate in non-millimeter/centimeter wave frequency bands (e.g., at one or more frequency bands below 10 GHz). In particular, antenna feed 176 may be coupled to transceiver circuitry 36 (in FIG. 2) using radio-frequency transmission line path 177. Impedance matching circuitry such as a matching network may be interposed on radio-frequency transmission line path 177.

Antenna 40' may also include one or more tunable components such as a first tunable component 178 and a second tunable component 180 (e.g., tunable components configured to tune the frequency response of antenna 40' for one or more frequency bands, to form return paths, to form open circuitry, etc.). Tunable component 178 may have a first terminal coupled to segment 220 at location 152 and a second (ground) terminal coupled to ground structures 216 at location 154. Tunable component 180 may have a first terminal coupled to segment 220 at location 162 and a second (ground) terminal coupled to ground structures 216 at location 164. Positive antenna feed terminal 172 may be interposed on segment 220 between locations 152 and 162.

If desired, ground structures 216 may include multiple conductive structures such as one or more conductive layers within device 10. For example, ground structures 216 may include a first conductive layer formed from a portion of housing 12 (e.g., a conductive backplate or support plate that forms part of rear housing wall 12R of FIG. 1) and a second conductive layer formed from a conductive display frame or support plate associated with display 14 (FIG. 1). In these scenarios, conductive interconnect structures (e.g., conductive screws, conductive brackets, conductive clips, conductive pins, conductive springs, solder, welds, conductive adhesive, conductive screw bosses, etc.) may electrically connect ground terminals for antenna feeds (e.g., terminal 174 for antenna 40') and/or tunable component terminals (e.g., ground terminals for component 178 and 180) to both the conductive display layer and the conductive housing layer. This may allow ground structures 216 to extend across both conductive portions of housing 12 and display 14 (FIG. 1) so that the conductive material closest to antennas 40' are held at a ground potential. This may, for example, serve to maximize the antenna efficiency of antenna 40'.

Antenna 40' may be configured to cover any desired communications bands. In one suitable arrangement that is sometimes described herein as an example, antenna 40' may convey radio-frequency signals in a cellular low band (e.g., between 617 and 960 MHz), a cellular low-mid band (e.g., between 1430 and 1510 MHz), a cellular mid band (e.g., between 1710 and 2170 MHz), a satellite navigation band (e.g., a GPS band between 1565 and 1605 MHz), and/or a cellular high band (e.g., between 2300 and 2700 MHz). Tunable component 178 may, for example, tune the frequency response of antenna 40-1 in the cellular midband and/or cellular low-midband. Tunable component 180 may, for example, tune the frequency response of antenna 40-1 in the cellular low band. In some configurations, the placement of antenna module 120 near antenna resonating element 68' may cause loading effects on antenna 40'. If desired, component 180 may be configured to compensate for the loading of antenna module 120 on antenna 40' (e.g., by include different sets of tunable components in scenarios where antenna module 120 is present or absent, by adjusting the different states of component 180 in scenarios where antenna module 120 is present or absent, etc.). This arrangement is merely illustrative.

Device 10 may include also include one or more antennas covering any other suitable communications bands (e.g., antennas other than antenna 40' and antennas in antenna module 120). One or more of these antennas may be formed from slot 150, segment 218, segment 222, segment 224, or other structures in device 10. These other antennas are not shown or described in detail in FIG. 9 in order to not unnecessarily obscure the embodiments described herein.

Still referring to FIG. 9, antenna module 120 may be disposed within slot 150 between segment 220 of peripheral conductive housing structures 12W and ground structure 216 (e.g., antenna module 120 may at least partially overlap slot 150). In particular, antenna module 120 may be disposed within slot 150 between a first portion of slot 150 across which antenna feed 176 for antenna 40' is coupled and a second portion of slot 150 across which tunable component 180 for antenna 40' is coupled. Arranged in this manner, antenna module 120 may also be aligned with notch 8 in the location as shown in FIG. 8.

An attachment structure 128 may be partially embedded in dielectric 70 of antenna module 120. An exposed portion of attachment structure 128 (not embedded in dielectric 70) may have an opening through which a conductive structure such as screw 182 extends to secure antenna module 120 in place within device 10. In the example of FIG. 9, a portion of attachment structure 128 (including screw 182) may form at least a portion of a conductive path through which a (non-ground) terminal of component 180 is coupled to segment 220 at location 162. Because attachment structure 128 and screw 182 are used in combination, attachment structure 128 may be described to be include screw 182. This configuration is merely illustrative. If desired, other conductive structures such as adhesive, pins, springs, clips, brackets, solder, welds, etc., may be used as part of attachment structure 128 to form the conductive path. If desired, the attachment structure 128 may form a conductive path between any other elements (e.g., other antenna elements for antenna 40' such as antenna feed 176, tunable component 178, a ground terminal of tunable component 180, for other antennas, etc.).

By sharing the use of attachment structure 128 (e.g., as a mechanical support structure for mounting antenna module 120, as an electrical connector between elements of antenna 40'), value space may be conversed in region 20 (FIG. 1) of device 10, which is particularly advantageous given the large number of components in region 20. Attachment structure 128 may be separated from resonating elements in antenna module 120 such as dielectric resonating element 68H closest to attachment structure 128 by a suitable distance (e.g., a distance greater than 0.5 mm a distance between 0.5 and 0.6 mm, a distance, greater than 0.6 mm, etc.) to avoid an undesirable coupling between antennas in antenna module 120 and antenna 40' through attachment structure 128, as an example. If desired, attachment structure 128 may be suitably distanced from other (conductive) elements in device 10 to avoid an undesirable coupling to elements in antenna 40' through attachment structure 128.

In the example of FIG. 9, substrate 72 is a flexible printed circuit having transmission lines 88 and ground structures (e.g., ground traces) that form a portion of the antenna ground for one or more antennas in device 10. A first end 72-1 of substrate 72 (sometimes referred to herein as a first end portion 72-2) may be coupled to antenna module 120 and a second end 72-2 of substrate 72 (sometimes referred to herein as a second end portion 72-2) may be coupled to substrate 140 (e.g., connector 123 on substrate 72 may be connected to connector 138 on substrate 140). Transmission lines 88 may be coupled to transceiver circuitry 38 (FIG. 1), which may be mounted on substrate 140, through connector 138 (e.g., and/or other conductive paths on substrate 140. Accordingly, transmission lines 88 may be configured receive radio-frequency signals from transceiver circuitry 38 and to feed antennas in antenna module 120 (e.g., dielectric resonating elements 68 using corresponding feed probes).

In the illustrative configuration of FIG. 9, antenna module 120 includes four dual-polarization antennas, and substrate 72 includes eight transmission lines 88 (one for each of the two feed probes for each of the four antennas). This is merely illustrative. If desired, any desired number of antennas of one or more types and the corresponding number of transmission lines may be provided for antenna module 120.

Substrate 140 may include ground structures forming a portion of the antenna ground (e.g., forming a portion of grounding structures 216 and/or connected to ground structures 216). The ground structures of substrate 140 and/or ground structures 216 may be connected to the ground structures such as ground traces on substrate 72 through connectors 123 and 138 at second end 72-2.

Because antenna module 120 is disposed in slot 150, first end 72-1, which extends to antenna module 120, also extends towards antenna resonating element 68' formed from segment 220 of peripheral conductive housing structures 12W. As described above, to maximize the antenna efficiency of antenna 40', it may be desirable to hold conductive structures closest to antenna 40' (e.g., closest to antenna resonating element 68') at a ground potential. In the case of the ground traces on substrate 72, these ground traces are grounded at second end 72-2 (e.g., at connector 123), and as such, ground traces that extend towards antenna 40' at second end 72-2 may float away from a ground potential and undesirably impact the antenna efficiency of antenna 40'.

To mitigate these issues, device 10 may include conductive structure 228 (e.g., at one or more locations 'x') at first end 72-1. Conductive structure 228 may couple (e.g., electrically connect) the ground traces or other ground structures of substrate 72 to ground structures 216, thereby holding these ground structures at a ground potential at first end 72-1 and consequently improving the antenna efficiency of antenna 40'. If desired, conductive structure 228 may be disposed at and/or along an edge of ground structures 216 defining slot 150. If desired, ground traces on substrate 72 may similarly terminate at or near this edge of ground structures 216 such that ground structures on substrate 72 do not extend substantially into slot 150 towards antenna resonating element 68'.

Conductive structure 228 may be formed from any suitable conductive and/or attachment structures such as conductive adhesive, a conductive foam, clips, screws, pins, springs, brackets, solder, welds, other conductive and/or attachment structures, or combinations of two or more of these structures. In the example of FIG. 9, conductive structure 228 is shown to be interposed between a lower surface of substrate 72 (surface 124 in FIG. 7) and an opposing surface of ground structures 216. This is merely illustrative. If desired, conductive structure 228 may disposed at any suitable location to ground the ground traces of substrate 72 at or near first end 72-1.

To provide improved millimeter/centimeter wave wireless communications capabilities, it may be desirable to include multiple dual-polarization antenna elements (e.g., antennas in antenna module 120). However, this may also require that substrate 72 include a large number of transmission lines and isolation structures between transmission lines. Consequently, substrate 72 may be bulkier, stiffer, and larger, thereby making assembling substrate 72 in a satisfactory manner more difficult. To facilitate the assembly of substrate 72 into device 10, substrate 72 may include an opening or slot 226, which improves the flexibility of substrate 72.

As shown in FIG. 9, slot 226 may extend completely through substrate 72, and may be an elongated slot extending along the elongated length dimension of substrate 72 (e.g., extending along transmission lines 88). In particular, slot 226 may extend between first end portion 72-1 and second end portion 72-1. In configurations where substrate 72 has a bend and/or is curved, slot 226 may have a curvature following the bend or curvature of substrate 72. If desired, slot 226 may be centered about one or more (curved) central axes of substrate 72 such that a number of signal paths (e.g., transmission lines 88) on either side (e.g., left and right opposing sides) of slot may be substantially the same. In other words, transmission lines 88 may split at a first end of slot 226, run along either side of slot 226 and meet at second opposing end of slot 226. These examples are merely illustrative. If desired, one or more slots with any suitable configurations (e.g., shapes, sizes, etc.) may be formed in substrate 72 to improve the assembly of substrate 72 in device 10.

However, if care is not taken, the existence of slot 226 may adversely impact antenna performance (e.g., of antenna 40', of antennas in module 120, etc.). In particular, because of the close proximity of antenna 40' and other antenna elements, slot 226 may unintentionally and undesirably resonate due to coupling with one or more nearby antenna elements (e.g., with antenna 40', antenna 40H, antenna 40L, etc.).

Figure 10:
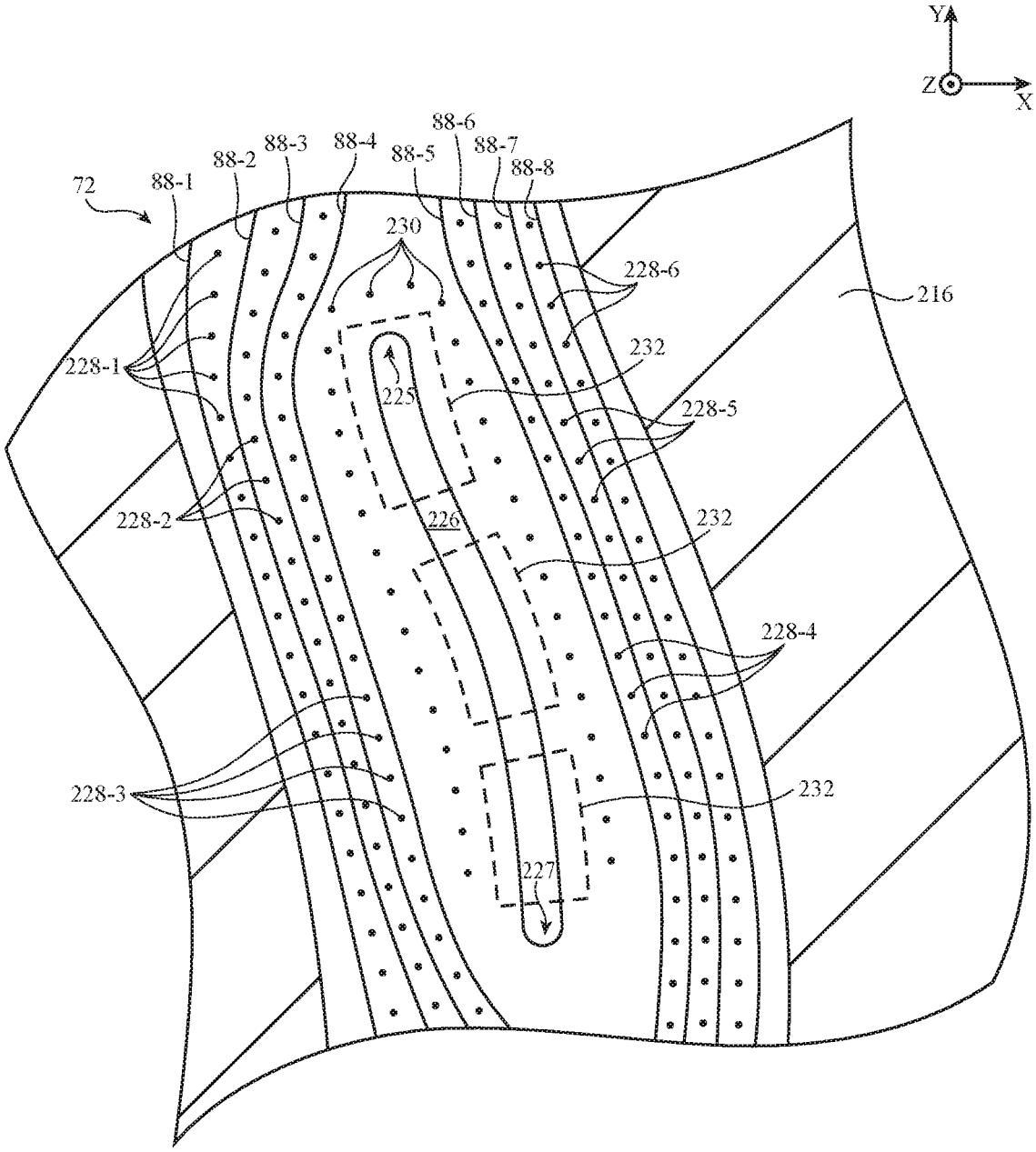
FIG. 10 is a top-down view of a slot portion of an illustrative slotted printed circuit in accordance with some embodiments.

To mitigate these issues, slot 226 in substrate 72 may be provided with additional isolation and/or conductive structures. FIG. 10 is a top down view of the portion of substrate 72 having slot 226. As shown in FIG. 10, substrate 72 may include transmission lines 88-1 to 88-8. Transmission lines 88-1 to 88-4 may run along a left edge of slot 226, while transmission lines 88-5 to 88-8 may run alone the right edge of slot 226. This is merely illustrative.

Substrate 72 may include a plurality of conductive vias 228 (sometimes referred to herein as a fence of conductive vias) that laterally surround each of transmission lines 88 on substrate 72. Conductive vias 228 may extend in the Z direction (at least partially or completely) through substrate 72. As an example, each conductive via 228 may connect and be shorted to one or more ground traces in substrate 72 to hold the ground traces at the same ground or reference potential as the ground traces. If desired, each conductive via 228 may be shorted to other traces in substrate 72. In particular, these conductive vias 228 may be disposed between two adjacent transmission lines to isolate the two transmission lines from each other. As an example, a first set or fence of conductive vias 228-1 may be disposed between transmission lines 88-1 and 88-2, a second set or fence of conductive vias 228-2 may be disposed between transmission lines 88-2 and 88-3, and a third set or fence of conductive vias 228-3 may be disposed between transmission lines 88-3 and 88-4. In a similar manner, sets or fences of conductive vias 228-4, 228-5, and 228-6 may be disposed between corresponding adjacent pairs of transmission lines from transmission lines 88-5, 88-6, 88-7, and 88-8.

Conductive vias 228 may be separated form one or more adjacent conductive vias in the same fence of conductive vias by a relatively short distance so as to effectively appear as a solid conductive wall to radio-frequency signals conveyed through transmission lines 88 and/or to radio-frequency signals at the frequency of operation of antennas 40H and 40L (e.g., the conductive vias may be separated by one-eighth the shortest effective wavelength of these radio-frequency signals, one-tenth the shortest effective wavelength, one-twelfth the shortest effective wavelength, one-fifteenth the shortest effective wavelength, less than one-eighth the shortest effective wavelength, etc.).

If desired, each fence of conductive vias 228 may run along the length of transmission lines 88 (e.g., past the portion of substrate 72 shown in FIG. 10, to end portion 72-1 and/or to end portion 7-2 in FIG. 9). If desired, there may be gaps or along the length of each of the fences of vias 228 (e.g., some portions of substrate 72 may lack conductive vias 228). If desired, adjacent vias in the same fence or in difference fences may be separated from each other by two or more different distances. These examples are merely illustrative. If desired, the fences of vias 228 may follow any desired lateral outline (e.g., the fences of conductive vias 228 may follow any desired straight and/or curved paths, with or without discontinuities).

As described above, if care is not taken, slot 226 in substrate 72 may undesirably resonate due to coupling from the antenna elements of antenna 40' in FIG. 9 (e.g., at a resonant frequency associated with signal frequencies at which the slot length is approximately equal to half of the effective wavelength of operation). In particular, substrate 72 may include conductive structures (e.g., conductive traces such as ground traces, signal traces, and other traces, vias, and/or other conductive structures). These conductive structures in substrate 72 may surround and define edges of slot 226 (e.g., define a dimension of slot 226 such as a conductive perimeter of slot 226, a conductive slot length of elongated slot 226, etc.). The dimension of slot 226 as defined by these conductive structures in substrate 72 may be conducive to unwanted resonance due to coupling from some neighboring antenna elements (e.g., antenna elements of antenna 40').

To mitigate these issues, one or more conductive structures 232 may overlap slot 226 and may be coupled to the conductive structures in substrate 72 on opposing sides of slot 226. Each conductive structure 232 may electrically connect (e.g., short) first conductive structures in substrate 72 on one side of slot 226 to second conductive structures in substrate 72 on the other opposing side of slot 226. As such, one or more conductive structures 232 may provide one or more corresponding conductive paths bridging elongated slot 226 across its width, thereby effectively altering the dimensions of slot 226 (e.g., shortening the effective length of slot 226 or forming one or more slots having shorter lengths than slot 226 within slot 226). In other words, without conductive structures 232, slot 226 may have a conductive perimeter fully defined by the conductive structures in substrate 72, but with conductive structures 232, slot 226 may be (electrically) separated or divided into one or more smaller (e.g., shorter) slots each having a conductive perimeter defined by both the conductive structures in substrate 72 and conductive structure 232.

As such, conductive structures 232 may effectively divide slot 226 into (e.g. may define or form) one or more shorter-length slots each having conductive perimeters and lengths that do not exhibit resonance at or near the frequencies of operation of antenna 40' (e.g., at non-millimeter/centimeter wave frequencies). As an example, a first conductive structure 232 may define an upper end of the shorter slot, a second conductive structure 232 may define a lower end of the shorter slot, and corresponding conductive structures in substrate 72 on opposing sides of the shorter slot may define the left and right edges of the shorter slot. This is merely illustrative. If desired, one of the upper or lower ends of the shorter slot may still be defined by corresponding conductive structures 72 instead of conductive structure 232.

As an example, conductive structures 232 may be disposed on a lower surface of substrate 72 (surface 124 in FIG. 7) and under slot 226. If desired, conductive structure 232 may be coupled to (e.g., shorted to) conductive structures in substrate 72 that define opposing edges of slot 226 (e.g., ground traces, vias, or other conductive traces) at the lower surface of substrate 72. If desired, conductive structures 232 may be coupled to and shorted to ground structures such as ground structures 216. Conductive structures 232 may be formed from one or more sheets of conductive tape or other thin and/or flexible conductive structures that do not negate the flexibility of substrate 72 imparted by slot 226. While three separate conductive structures 232 are shown in FIG. 10, this is merely illustrative. Any number of conductive structures of any suitable types and in any suitable configuration may be used to alter the effective length of slot 226 while substantially preserving the flexibility of substrate 72 imparted by the existence of slot 226. As an example, conductive structures 232 may be disposed on an upper surface of substrate 72 (surface 122 in FIG. 7) and over slot 226, and/or within slot 226. As other examples, conductive structures 232 may include conductive adhesive, conductive foam, conductive brackets, conductive clips, sheet metal, conductive traces, solder, welds, or other conductive structures.

While the shorter slots (e.g., formed from the division of slot 226 by conductive structures 232) do not exhibit resonance at the frequencies of operation of antenna 40', the shorter slot lengths may undesirably exhibit resonance at higher frequencies if coupled with elements for antennas 40H and 40L (e.g., transmission lines 88, resonating elements 68, etc.). To mitigate these issues, a fence of conductive vias 230 may surround slot 226, and may isolate slot 226 and shield slot 226 from any undesired coupling to slot 226 from elements of antennas 40H and 40L. In particular, as shown in the example of FIG. 10, the fence of conductive vias 230 may run around the top end 225 of slot 226 and may run along the left and right sides of slot 226. If desired, the fence of conductive vias 230 may also separate slot 226 from adjacent transmission lines (e.g., transmission lines 88-4 and 88-5).

If desired, the fence of conductive vias may terminate on the left and right sides of slot 226 before reaching bottom end 227 of slot 226. In particular, end 225 may be closer to antenna resonating elements for antennas 40H and 40L than end 227 and may therefore necessitate isolation. Alternatively, if desired, the fence of conductive vias may also run around end 227. In general, the fence of conductive vias 230 may have gaps or discontinuities where shielding or isolation of slot 226 is not essential. In other words, the fence of conductive vias 230 may laterally surround (completely or partially) slot 226 in substrate 72.

Conductive vias 230 may extend in the Z direction (at least partially or completely) through substrate 72. As an example, each conductive via 230 may connect and be shorted to one or more ground traces in substrate 72 to hold them at the same ground or reference potential as the ground traces. If desired, each conductive 228 via may be shorted to other traces in substrate 72. Conductive vias 230 may be separated form one or more adjacent conductive vias in the same fence of conductive vias by a relatively short distance so as to effectively appear as a solid conductive wall to radio-frequency signals conveyed through transmission lines 88 and/or to radio-frequency signals at the frequency of operation of antennas 40H and 40L (e.g., the conductive vias may be separated by one-eighth the shortest effective wavelength of these radio-frequency signals, one-tenth the shortest effective wavelength, one-twelfth the shortest effective wavelength, one-fifteenth the shortest effective wavelength, less than one-eighth the shortest effective wavelength, etc.).

These examples are merely illustrative. If desired, the fence of vias 230 may follow any desired lateral outline (e.g., the fences of conductive vias 230 may follow any desired straight and/or curved paths, with or without discontinuities).

Figure 11:
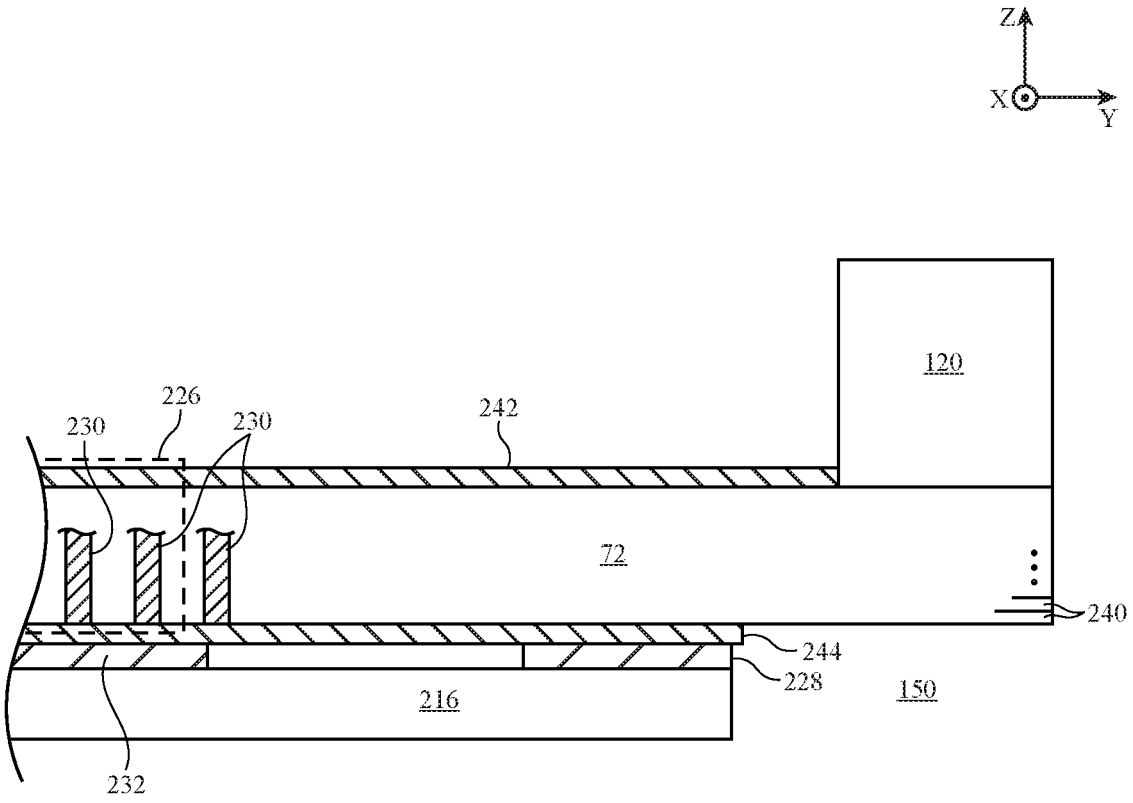
FIG. 11 is a cross-sectional view of a portion of an illustrative slotted printed circuit that is coupled to ground structures in accordance with some embodiments.

FIG. 11 is a cross-sectional view of substrate 72 coupled to ground structures 216 and antenna module 120 for device 10. As shown in FIG. 11 substrate 72 may include stacked dielectric layers 240. Dielectric layers 240 may include polyimide, ceramic, liquid crystal polymer, plastic, and/or any other desired dielectric materials. Conductive traces such as conductive traces 242 may be formed on a top surface of substrate 72. Conductive traces 242 may form transmission lines for antennas 40H and 40L and may therefore sometimes be referred to herein as signal traces 242. Conductive traces such as conductive traces 244 may be pattern on an opposing bottom surface of substrate 72. Conductive traces 244 may be held at a ground potential and may therefore sometimes be referred to herein as ground traces 244.

Ground traces 244 may be shorted to additional ground traces within substrate 72 and/or on the top surface of substrate 72 using conducive vias that extend through substrate 72 (e.g., conductive vias 230 and 228). As described in connection with FIG. 10, fences of conductive vias 228 may separate adjacent transmission lines (e.g., adjacent signal traces 242). Fences of conductive vias 230 may laterally surround slot 226 (as also shown in FIG. 11) and may separate slot 226 from transmission lines 88. Ground traces 244 may form part of the antenna ground for antennas in device 10. Ground traces 244 may be coupled to a system ground in device 10 such as ground structures 216 (e.g., using solder, welds, conductive adhesive, conductive tape, conductive brackets, conductive pins, conductive screws, conductive clips, combinations of these, etc.). As an example, conductive structures 228 may connected ground traces 244 to ground structures 216 to hold ground traces 244 at end 72-1 of substrate 72 at a ground potential. As another example, conductive structures 232 under slot 226 may connect ground traces adjacent to slot 226 to ground structures 216.

The example of FIG. 11 in which conductive traces 242 are formed on the top surface and ground traces 244 are formed on the bottom surface of substrate 72 is merely illustrative. If desired, one or more dielectric layers 240 may be layered over conductive traces 242 and/or one or more dielectric layers 240 may be layered under ground traces 244.

Device 10 may gather and/or use personally identifiable information. It is well understood that the use of personally identifiable information should follow privacy policies and practices that are generally recognized as meeting or exceeding industry or governmental requirements for maintaining the privacy of users. In particular, personally identifiable information data should be managed and handled so as to minimize risks of unintentional or unauthorized access or use, and the nature of authorized use should be clearly indicated to users.

The foregoing is merely illustrative and various modifications can be made by those skilled in the art without departing from the scope and spirit of the described embodiments. The foregoing embodiments may be implemented individually or in any combination.

What is claimed is:

1. An electronic device comprising:

a housing having peripheral conductive housing structures;

an antenna ground;

a first antenna formed from the peripheral conductive housing structures and the antenna ground;

an antenna module, wherein the antenna module comprises a second antenna and is mounted between the peripheral conductive housing structures and the antenna ground;

a flexible printed circuit having a transmission line coupled to the second antenna;

a slot in the flexible printed circuit and having opposing first and second sides, wherein the flexible printed circuit has a first conductive trace at the first side and a second conductive trace at the second side; and a conductive structure that at least partially overlaps the slot and that forms a conductive path that shorts the first conductive trace to the second conductive trace across the slot.

2. The electronic device defined in claim 1, wherein the flexible printed circuit has first and second opposing surfaces and the slot extends through the flexible printed circuit from the first surface to the second surface.

3. The electronic device defined in claim 2, wherein the conductive structure is interposed between the second surface of the flexible printed circuit and the antenna ground, the conductive structure being coupled to the antenna ground.

4. The electronic device defined in claim 2, wherein the flexible printed circuit has a bend and the slot is elongated along a length of the flexible printed circuit.

5. The electronic device defined in claim 1 further comprising:

an additional conductive structure that at least partially overlaps the slot and that forms an additional conductive path across the slot, wherein the conductive path and the additional conductive path define first and second ends of an additional slot formed within the slot.

6. The electronic device defined in claim 5, wherein the conductive structure and the additional conductive structure comprise conductive tape.

7. The electronic device defined in claim 5, wherein the first antenna is configured to convey radio-frequency signals at a first frequency less than 10 GHz and the second antenna is configured to convey radio-frequency signals at a second frequency greater than 10 GHz.

8. The electronic device defined in claim 7, wherein the additional slot has a resonant frequency greater than the first frequency.

9. The electronic device defined in claim 1, wherein the flexible printed circuit includes a fence of conductive vias extending through the flexible printed circuit and laterally surrounding the slot.

10. The electronic device defined in claim 9, wherein the slot has opposing first and second ends, the first and second sides extend from the first end to the second end, and the fence of conductive vias run along the first and second sides of the slot and around the first end, the first end being between the antenna module and the second end.

11. The electronic device defined in claim 1, wherein the transmission line is coupled to the second antenna at a first end of the flexible printed circuit and is connected to transceiver circuitry for the second antenna at a second end of the flexible printed circuit, the flexible printed circuit comprising ground traces that are shorted to the antenna ground at the first end of the flexible printed circuit.

12. An electronic device comprising:

an antenna module having a phased antenna array configured to convey radio-frequency signals at a frequency greater than 10 GHz; and a flexible printed circuit coupled to the antenna module and including:

a plurality of transmission lines for the phased antenna array, a first fence of conductive vias that separates a first transmission line of the plurality of transmission lines from a second transmission line of the plurality of transmission lines, a slot, and a second fence of conductive vias that surrounds the slot and that separates the slot from the second transmission line.

13. The electronic device defined in claim 12, wherein the flexible printed circuit comprises conductive traces, and each conductive via in the first and second fences of conductive vias extends through the flexible printed circuit and is coupled to the conductive traces.

14. The electronic device defined in claim 13, wherein the conductive traces comprise ground traces that form an antenna ground.

15. The electronic device defined in claim 12, further comprising:

a plurality of conductive structures that overlap the slot to define at least one additional slot shorter than the slot.

16. The electronic device defined in claim 15, wherein the second fence of conductive vias is configured to shield the additional slot from the phased antenna array.

17. An electronic device comprising:

a housing having peripheral conductive housing structures;

an antenna ground separated from the peripheral conductive housing structures by a slot;

a first antenna formed from the peripheral conductive housing structures and the antenna ground;

a second antenna that overlaps the slot; and a flexible printed circuit having a transmission line for the second antenna and having ground traces, wherein the ground traces are coupled to the antenna ground at an edge of the slot.

18. The electronic device defined in claim 17, wherein the second antenna is in an antenna module mounted to the electronic device by an attachment structure and overlapping the slot.

19. The electronic device defined in claim 18, wherein the first antenna comprises a tunable component coupled across the slot and the attachment structure is configured to form a conductive path from the peripheral conductive housing structures to the tunable component.

20. The electronic device defined in claim 17, wherein the transmission line is coupled to the second antenna at a first end and coupled to transceiver circuitry for the second antenna at a second end, the ground traces being coupled to the antenna ground at the second end.

* * * * *